US008084181B2

(12) United States Patent
Inoue et al.

(10) Patent No.: US 8,084,181 B2
(45) Date of Patent: Dec. 27, 2011

(54) CARRIER AND METHOD FOR PRODUCING THE SAME, DEVELOPER AND IMAGE FORMING METHOD

(75) Inventors: Ryota Inoue, Mishima (JP); Masayuki Ishii, Numazu (JP); Yoshihiro Moriya, Numazu (JP); Takuya Seshita, Hiratsuka (JP); Shingo Sakashita, Numazu (JP); Chiaki Tanaka, Izunokuni (JP)

(73) Assignee: Ricoh Company, Ltd., Tokyo (JP)

( * ) Notice: Subject to any disclaimer, the term of this patent is extended or adjusted under 35 U.S.C. 154(b) by 875 days.

(21) Appl. No.: 12/112,514

(22) Filed: Apr. 30, 2008

(65) Prior Publication Data

US 2008/0280224 A1 Nov. 13, 2008

(30) Foreign Application Priority Data

May 11, 2007 (JP) ..... 2007-126898

(51) Int. Cl.
*G03G 5/00* (2006.01)

(52) U.S. Cl. ..... 430/137.13

(58) Field of Classification Search ..... 430/137.13
See application file for complete search history.

(56) References Cited

U.S. PATENT DOCUMENTS 5,514,512 A 5/1996 Cunningham et al.

FOREIGN PATENT DOCUMENTS

| | | |
|---|---|---|
| JP | 55-157751 | 8/1980 |
| JP | 55-127569 | 10/1980 |
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 2626754 | 4/1997 |
| JP | 9-269614 | 10/1997 |
| JP | 9-319161 | 12/1997 |
| JP | 10-186731 | 7/1998 |
| JP | 2006-106208 | 4/2006 |
| JP | 2007-183496 | 7/2007 |
| JP | 2007-248922 | 9/2007 |

OTHER PUBLICATIONS

U.S. Appl. No. 12/209,583, filed Sep. 12, 2008, Seshita et al.

*Primary Examiner* — Mark Chapman
(74) *Attorney, Agent, or Firm* — Oblon, Spivak, McClelland, Maier & Neustadt, L.L.P.

(57) ABSTRACT

To provide a method for producing a carrier including treating a coating layer on a surface of a core material with a polymer precursor in a supercritical fluid and/or a subcritical fluid so as to add the polymer precursor to the coating layer, and subjecting the coating layer to oxidation treatment so as to form a polymer from the polymer precursor in the coating layer, and a carrier produced by the method.

10 Claims, 6 Drawing Sheets

CARRIER AND METHOD FOR PRODUCING THE SAME, DEVELOPER AND IMAGE FORMING METHOD

BACKGROUND OF THE INVENTION

1. Field of the Invention

The present invention relates to a carrier for developing a latent electrostatic image, which is suitably used for electrophotography, electrostatic recording, electrostatic printing and the like and a method for producing the carrier, a developer using the carrier, and an image forming method using the developer.

2. Description of the Related Art

In a dry developing system used for electrophotography, a visible image is formed by making a toner frictioned with a charging member electrostatically adhered on a latent electrostatic image. Such dry development systems include a one-component development system using toner as the main component and a two-component development system using glass beads, magnetic carriers, or carriers prepared by coating the surfaces of such materials with a resin or the like, in combination with toner.

In a developer used in such a two-component development system, minute toner particles are held on relatively large core material surfaces by an electric force produced by friction therebetween. When this developer is made close to a latent electrostatic image owing to an electric field formed by the latent electrostatic image, the toner overcomes the binding force with the core material, and transferred on the latent electrostatic image to develop this image. Then, the developer is repeatedly used while being replenished with the toner consumed by development.

Therefore, during use over an extended period of time, the core material must always frictionally charge the toner with a desired polarity and to a sufficient amount of charge. However, due to inter-particle collision, mechanical stirring of particles within a development device, or heat generation caused by these phenomena, a phenomenon called "spent toner" occurs where the toner is fusion-bonded to the surface of the core material, and thereby charge characteristics of the core deteriorates with operating time. As a result, since background smearing of an image and toner scattering occur, it becomes necessary to replace the entire developer.

For preventing such a spent phenomenon, many proposals have been made for extending the lifespan of carriers by coating the surface of the core material with a resin having a low surface energy, for example, a fluorine resin, a silicone resin, or the like. The proposed carriers include, for example, a carrier coated with a room-temperature curable silicone resin and a positive charge nitrogen resin (see Japanese Patent Application Laid-Open (JP-A) No. 55-127569), a carrier coated with a coating material containing at least one type of modified silicone resin (see JP-A No. 55-157751), a carrier having a coating layer containing a room-temperature curable silicone resin and a styrene-acryl resin (see JP-A No. 56-140358), a carrier for which the surface of a core particle is coated with two or more layers of silicone resin, with no adhesion provided between the adjacent layers (see JP-A No. 57-96355), a carrier for which a multilayered silicone resin is applied to the surface of a core particle (see JP-A No. 57-96356), a carrier whose surface is coated with a silicone resin containing silicon carbide (see JP-A No. 58-207054), a positively charged carrier coated with a material having a critical surface tension of 20 dyn/cm or less (see JP-A No. 61-110161), and a developer composed of carriers coated with a coating material containing fluorinated alkyl acrylate and a toner containing a chromium-containing azo dye (see JP-A No. 62-273576).

Recently, there has been a trend to reduce the particle diameter of toner for realizing a high image quality, and as a result, toner spent to the carrier easily occurs. In addition, by a conventional spray coating, it is difficult to uniformly moisten the carrier surface with a coating material, and therefore, it is difficult to produce a carrier having adhesion between the coating film and core material and a uniform film thickness and film quality. Furthermore, in the case of a full-color toner, since a low-softening-point resin is used in order to obtain a sufficient color tone, in comparison with that of a black toner, the spent amount to the carrier is large, the amount of toner charge is lowered, and toner scattering and background smear occur. Thus, a full-color electrophotographic system has a problem that the image density of, in particular, a highlight is easily changed and a high image quality cannot be maintained when the amount of toner charge is lowered.

When carrier having higher electric resistance is employed for developer, generally, the resulting image is provided sharply with a so-called edge effect such that image density is very light at central portion and dense only at edge portion in a copy image of larger area. In cases where images are characters or thin limes, the edge effect may result in clear images, but there arises such a drawback that reproducibility of images is very poor in cases of halftone images. Therefore, particularly in case where a full-color toner is used, the electric property of carrier is necessary to be appropriately controlled so as to form a halftone image having high quality and a sufficient color tone.

For improved carrier durability and formation of high quality image, it has also been proposed to provide a coating layer of resin matrix composed of low surface energy substance, in which fine particles and a conductivity-imparting material are dispersed, to thereby control spent resistance, film strength, and electrical characteristics (see JP-A Nos. 09-319161, 09-269614, and 10-186731). However, in these proposals, since a dispersion prepared by adding fine particles to an organic solvent is applied by high-temperature spray coating, there is a problem that it is difficult to unify the amount of charge due to aggregation of the fine particles.

It has been also proposed that as a conductivity-imparting material, a coating layer, in which a conductive polymer substance is dispersed in a resin, is disposed on a surface of a core material so as to control electric resistance of the carrier surface (Japanese Patent (JP-B) No. 2626754). However, it is difficult for the conductive polymer to be uniformly dispersed in the coating layer because of poor compatibility between resins, and stable resistance cannot be obtained.

Conventional spray coating techniques also suffer from operational problems, such as regulation of volatile organic compounds (VOC) resulting from an organic solvent used for formation of a coating layer on the surface of the core material, generation of liquid waste, and requirement of energy for drying.

In order to overcome these problems, for example, as methods for producing carrier that involve an organic solvent-free dry powder process, production methods that involve use of a supercritical fluid have been proposed (see U.S. Pat. No. 5,514,512). However, this proposal discloses application of a coating resin, which has been polymerized in a supercritical fluid, by melting it in a heated state, and the coating resin is an acrylic resin; thus the aforementioned toner spent problem has not yet been solved.

Furthermore, in the method for producing carrier using a supercritical fluid (see JP-A No. 2006-106208), a silicone resin is used for the coating material; however, its solubility to the supercritical fluid is insufficient, and a carrier is produced through a process in which a plasticized and microdispersed silicone resin is sprayed simultaneously with a core material for coating of the core material surface. For this reason, it results in non-uniform thickness of the coating layer, and therefore, it results in failure to obtain a coating layer thickness sufficient to ensure carrier durability. Moreover, the method for producing the carrier includes a step of dispersing a conductivity-imparting material in a resin matrix. However, since the conductivity-imparting material is dispersed by kneading, it is not sufficiently finely dispersed. Therefore, the problem of non-uniform composition caused by aggregation of the fine particles has not been solved.

Accordingly, there has not yet been provided a carrier that has a coating layer having a uniform and appropriate thickness on the surface of a core material and has a high adhesion property between the core material and the coating layer and sufficiently satisfiable related techniques thereof. Further, from the perspective of environmental burden and resource-saving, the current situation is that conventional methods of producing a carrier and conventional carriers have various problems to be solved.

BRIEF SUMMARY OF THE INVENTION

The present invention aims to provide a carrier which has a coating layer on a surface of a core material, wherein the coating layer has a uniform thickness, has a high-adhesion property to the core material and high mechanical strength, and also aims to provide a method for producing the carrier, a developer using the carrier, which is capable of forming a fine, high-quality image at a high-image density for a long time without substantially causing toner scattering, background smear and edge effect, and an image forming method using the developer.

The means for solving the aforementioned problems are as follows:

<1> A method for producing a carrier including treating a coating layer on a surface of a core material with a polymer precursor in a supercritical fluid and/or a subcritical fluid so as to add the polymer precursor to the coating layer, and subjecting the coating layer to oxidation treatment so as to form a polymer from the polymer precursor in the coating layer.

<2> The method for producing a carrier according to <1>, wherein the polymer formed from the polymer precursor has electrical conductivity.

<3> The method for producing a carrier according to any one of <1> to <2>, wherein the polymer precursor is at least one selected from compounds partly having at least one of a five-membered aromatic structure and an aniline structure.

<4> The method for producing a carrier according to <3>, wherein the compound partly having at least one of a five-membered aromatic structure and an aniline structure is at least one selected from pyrrole, pyrrole derivative and aniline.

<5> The method for producing a carrier according to any of <1> to <4>, wherein the oxidation treatment is performed using an oxidant.

<6> The method for producing a carrier according to <5>, wherein the oxidant contains at least one selected from a transition metal chloride, a halogen atom and a peroxyacid compound.

<7> The method for producing a carrier according to any of <1> to <6>, further including dissolving and/or dispersing at least a coating resin in the supercritical fluid and/or the subcritical fluid so as to form the coating layer on the surface of the core material.

<8> The method for producing a carrier according to any of <1> to <7>, wherein the supercritical fluid and/or the subcritical fluid is carbon dioxide.

<9> A carrier produced by the method for producing a carrier according to any of <1> to <8>.

<10> A developer containing the carrier according to <9> and a toner.

<11> An image forming method including forming a latent electrostatic image on a latent electrostatic image bearing member, developing the latent electrostatic image using the developer according to <10> so as to form a visible image, transferring the visible image to a recording medium, and fixing the transferred visible image on the recording medium.

<12> An image forming apparatus including a latent electrostatic image bearing member, a latent electrostatic image forming unit configured to form a latent electrostatic image on the latent electrostatic image bearing member, a developing unit configured to develop the latent electrostatic image using the developer according to <10> so as to form a visible image, a transferring unit configured to transfer the visible image to a recording medium, and a fixing unit configured to fix the transferred visible image on the recording medium.

<13> A process cartridge containing a latent electrostatic image bearing member, and a developing unit configured to develop the latent electrostatic image formed on the latent electrostatic image bearing member using the developer according to <10> so as to form a visible image.

The method for producing a carrier of the present invention includes at least treating a coating layer on a surface of a core material with a polymer precursor in a supercritical fluid and/or a subcritical fluid so as to add the polymer precursor to the coating layer, and subjecting the coating layer to oxidation treatment so as to form a polymer from the polymer precursor in the coating layer. According to the method for producing a carrier of the present invention, a carrier having high mechanical strength, toner charging ability and stability over time can be efficiently produced because the carrier has the coating layer on the surface of the core material, wherein the coating layer has a uniform thickness, a high-adhesion property to the core material and a polymer (conductive polymer) formed from a polymer precursor is uniformly dispersed therein.

The developer of the present invention contains the carrier of the present invention and a toner. By using the developer, an image having high image density without toner scattering and background smears can be formed.

The image forming method includes at least a latent electrostatic image forming step, a developing step, a transferring step and a fixing step. According to the image forming method used in the present invention, in the latent electrostatic image forming step, a latent electrostatic image is formed on a latent electrostatic image bearing member. In the developing step, the latent electrostatic image is developed using the developer of the present invention to form a visible image. In the transferring step, the visible image is transferred to a recording medium. In the fixing step, the transferred visible image is fixed on the recording medium. As a result, a high quality, sharp image having a high image density without toner scattering and background smears can be obtained.

Figure 1:
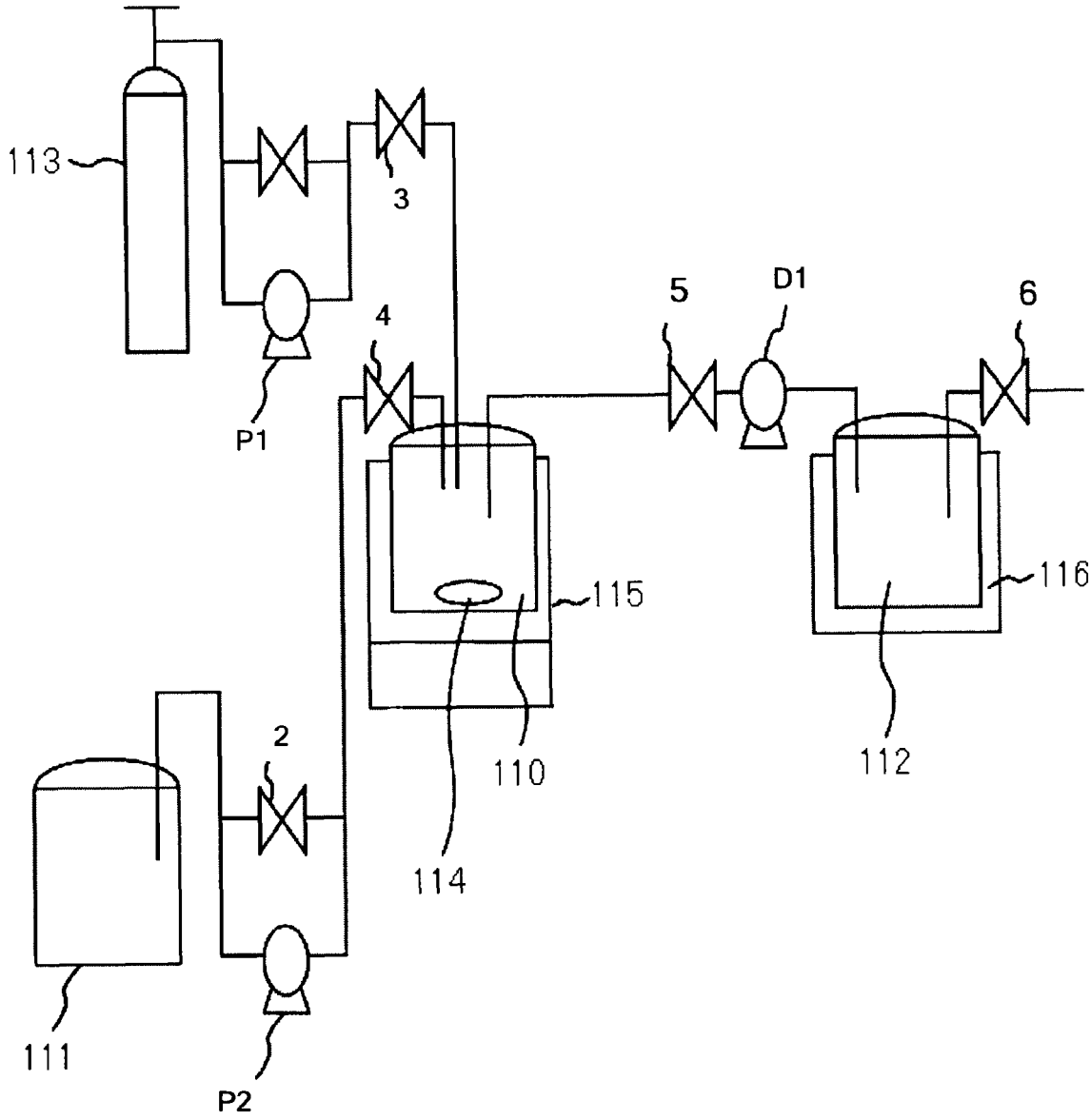
FIG. 1 is a schematic view showing an example of a device used for a method for producing a carrier of the present invention.

DETAILED DESCRIPTION OF THE INVENTION (Method for Producing Carrier and Carrier)

A method for producing a carrier of the present invention includes at least a coating layer treatment step and an oxidation treatment step, and further includes a coating layer formation step and other steps as necessary.

A carrier of the present invention is produced by a method for producing a carrier of the present invention.

Hereinafter, details of the carrier of the present invention will be clarified with explanation of the method for producing a carrier of the present invention.

<Coating Layer Formation Step>

The coating layer formation step is a step of forming a coating layer on a surface of a core material. The method for forming the coating layer is not particularly limited as long as the coating layer can be formed on the surface of the core material, and may be appropriately selected according to the purpose. Examples thereof include (1) a method in which a coating solution for coating layer containing at least a coating resin is coated on the surface of the core material using a fluidized-bed coating device or the like, and then heated to form the coating layer on the surface of the core material, and (2) a method in which at least a coating resin is dissolved and/or dispersed in a supercritical fluid and/or subcritical fluid so as to form the coating layer on the surface of the core material. Of these, the latter method is preferred because a carrier can be efficiently produced while meeting the volatile organic compounds (VOC) regulations, producing no liquid waste, and requiring little drying energy.

-Supercritical Fluid and Subcritical Fluid-

The supercritical fluid means a fluid that has intermediate properties between a gas and a liquid, has properties such as being fast in mass transfer and heat transfer (as a liquid) and being low in viscosity (as a gas), and can continuously greatly change the density, dielectric constant, solubility parameter, free volume, and the like by changing the temperature and pressure. Furthermore, the supercritical fluid can even follow a minute undulation (surface) to wet the surface with the supercritical fluid (contact with the supercritical fluid) since it has an extremely small surface tension compared with those of organic solvents.

As the supercritical fluid, any supercritical fluid can be used without particular limitation as long as it is a fluid that exists as a noncondensable high-density fluid in a temperature and pressure region exceeding a limit (critical point) where a gas and a liquid can coexist, does not condensate when being compressed, and is in a state of a critical temperature or more and a critical pressure or more, and may be appropriately selected according to the purpose. For example, a supercritical fluid having a low critical temperature and critical pressure is preferable. In addition, as the subcritical fluid, any subcritical fluid can be used without particular limitation as long as it exists as a high-pressure liquid in a temperature and pressure region in the vicinity of the critical point, and may be appropriately selected according to the purpose.

Examples of the supercritical fluid or subcritical fluid include carbon monoxide, carbon dioxide, ammonia, nitrogen, water, methanol, ethanol, ethane, propane, 2,3-dimethylbutane, benzene, chlorotrifluoromethane, and dimethyl ether. Of these, carbon dioxide is particularly preferable since this can easily reach a supercritical state at a critical pressure of 7.3 MPa and a critical temperature of 31° C., is nonflammable and highly safe, allows to obtaining a carrier with a hydrophobic surface as this is a nonaqueous solvent, and is globally environmentally friendly from the point of easy recovery and recycling as this is gasified by only restoring the pressure to a normal pressure (releasing pressure), no drying is required for a carrier obtained, and no liquid waste is produced.

For the supercritical fluid or the subcritical fluid, one of these may be used alone or two or more may be used in combination as a mixture. When used in combination, it is natural to include a supercritical fluid or a subcritical fluid.

Besides the supercritical fluid and/or subcritical fluid, another fluid can be used in combination. As such another fluid, one that can easily control solubility of the coating resin is preferable. Examples thereof include methane, ethane, propane and ethylene.

Furthermore, besides the supercritical fluid and/or subcritical fluid, an entrainer (azeotropic agent) can also be added. This addition of an entrainer enhances the solubility of the coating resin. Although the entrainer is not particularly limited and may be appropriately selected according to the purpose, a polar organic solvent is preferable. Examples of the polar organic solvents include methanol, ethanol, propanol, butanol, hexane, toluene, ethyl acetate, chloroform, dichloromethane, ammonia, melamine, urea and thioethyleneglycol. Of these, lower alcohol solvents having 4 to 6 carbon atoms (preferably 1 to 4 carbon atoms) that exhibit a poor solvency under normal temperature and normal pressure are preferably used.

The amount of the entrainer in a fluid mixture consisting of at least one of the supercritical fluid and the subcritical fluid, and the entrainer is preferably 0.1% by mass to 10% by mass, and more preferably 0.5% by mass to 5% by mass. The amount of less than 0.1% by mass may make it difficult to obtain an effect of the entrainer. The amount of more than 10% by mass may result in too strong liquid property of the entrainer and thus it may become difficult to obtain the supercritical or subcritical state.

-Coating Resin-

The coating resin is not particularly limited and may be appropriately selected from known resins according to the purpose. Examples thereof include amino resins, polyvinyl resins, polystyrene resins, halogenated olefin resins, polyester resins, polycarbonate resins, polyethylene resins, polyvinyl fluoride resins, polyvinylidene-fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as a terpolymer of tetrafluoroethylene, vinylidene fluoride, a non-fluorinated monomer, and silicone resins. These may be used alone or in combination. Of these, silicone resins are particularly preferable in terms of high effectiveness.

As silicone resins, synthesized resins or commercially available products may be appropriately used. The commercially available products include straight silicone resins of KR271, KR255, KR220L, and KR152 manufactured by Shin-Etsu Chemical Co., Ltd.; SR2400, SR2406, SR2410, SR213, 217 Flake Resin, 220 Flake Resin, 233 Flake Resin, 249 Flake Resin, and Z-6018 Intermediate manufactured by Dow Corning Toray Co., Ltd.

In addition, as silicone resins, modified silicone resins can be also used, and examples thereof include KR206 (alkyd modification), KR5208 (acrylic modification), ES1001N (epoxy modification), and KR305 (urethane modification) manufactured by Shin-Etsu Chemical Co., Ltd.; SR2115 (epoxy modification), SR2110 (alkyd modification) by Dow Corning Toray Co., Ltd.

In the coating layer, a silane coupling agent, fine particles and/or an electric resistance control agent may be added as necessary.

-Core Material-

The core material is not particularly limited and any core material may be appropriately selected from ones known as electrophotographic two-component carriers according to the purpose, and, suitable examples thereof include ferrite, magnetite, iron, and nickel. In addition, with increasing considerations for the environment in recent years, it is suitable to use, in the case of ferrites, for example, Mn ferrites, Mn—Mg ferrites, Mn—Mg—Sr ferrites, and the like, rather than conventional copper-zinc ferrites.

As the core material, one having a volume-average particle diameter of 20 μm or more is preferable in terms of prevention of carrier adhesion (scattering) to a latent electrostatic image bearing member, one having a volume-average particle diameter of 100 μm or less is preferable in terms of prevention of poor image quality such as generation of carrier lines, and in particular, for a movement in image quality in recent years, one having a volume-average particle diameter of 20 μm to 50 μm is more preferable.

Here, the volume-average particle diameter of the core material may be measured, for example, by use of a "Microtrac Particle-Size Analyzer SRA" manufactured by Nikkiso Co., Ltd. with a range setting of 0.7 μm to 125 μm.

Next, a carrier production device used for forming the coating layer in the method for producing a carrier of the present invention is not particularly limited and may be appropriately selected according to the purpose. For example, a device is preferably exemplified which is equipped with at least a pressure-proof vessel used to dissolve a coating material and a pressurizing pump used to supply the carbon dioxide in a liquid state. In a treatment using the device, first, at least a coating resin is put in the pressure-proof vessel, and then supplied with the carbon dioxide in a liquid state using the pressurizing pump to dissolve the coating resin in the carbon dioxide in a liquid state. Next, the pressure of the carbon dioxide in a liquid state is reduced and the pressure and the temperature of the carbon dioxide are restored to the normal pressure and normal temperature, and then the solubility of the coating resin is reduced to thereby form a coating layer on the surface of the core material. Because the carbon dioxide in a liquid state becomes a gas as stated above, there is no need to remove the solvent, moreover waste water that could be produced in washing is not produced, thereby reducing the burden to environments.

By the coating layer formation step, in the method for producing a carrier of the present invention, a coating layer can be formed on the surface of the core material by use of, for example, a device shown in FIG. 1.

The device shown in FIG. 1 will be now explained below. In a carrier treatment tank 110, a coating resin and a core material are loaded, a valve 3 is opened while stirring the components with a stirrer 114, carbon dioxide is supplied from a carbon dioxide cylinder 113 by means of a pressurizing pump P1, the pressure and the temperature of the pressurizing pump P1 is set at 25 MPa and 15° C., and then the valve 3 is closed. The inside of the carrier treatment tank 110 is kept at 25 MPa and 15° C. for 2 hours, then a valve 5 and a valve 6 are opened, the inside of the carrier treatment tank 110 is increased in temperature to 40° C., and then the valves 5 and 6 are closed.

Next, the inside of the carrier treatment tank 110 is kept at 25 MPa and 40° C. for 0.5 hours, then the valves 5 and 6 are opened, and the pressure of the inside of the carrier treatment tank 110 is restored to the normal pressure range by means of a depressurizing pump D1 for 2 hours. Further, the inside of the carrier treatment tank 110 is heated at 160° C. for 2 hours to thereby produce a carrier. A coating resin and a core material that have not been used can be collected and recycled from both the carrier treatment tank 110 and a raw material collection tank 112.

Further, as necessary, the carrier treatment tank 110 may be supplied with an entrainer from an entrainer tank 111 by means of a pressurizing pump P2. Thereafter, a valve 2 and a valve 4 may be closed.

Note that in FIG. 1, a reference numeral 115 denotes a thermostat jacket, and a reference numeral 116 denotes a cooling jacket.

<Coating Layer Treatment Step>

The coating layer treatment step is a step of treating a coating layer on a surface of a core material with a polymer precursor in a supercritical fluid and/or subcritical fluid so as to add the polymer precursor to the coating layer.

The form in which the polymer precursor is added is not particularly limited as long as the polymer precursor is added to the coating layer in some form. Examples the forms include a form in which the polymer precursor adheres to the surface of the coating layer, a form in which the polymer precursor is partly contained in the coating layer, a form in which the polymer precursor is contained in the coating layer, and combinations thereof. Of these, the form in which the polymer precursor is contained in the coating layer is preferred, and particularly preferred is the form in which the polymer precursor is uniformly dispersed in the coating layer.

The supercritical fluid and/or subcritical fluid similar to that used in the coating layer formation step may be used. By using a carrier production device shown in FIG. 1, the coating layer is formed, and subsequently is preferably treated with the polymer precursor.

Alternatively, a coating solution for coating layer containing at least the coating resin may be applied on a surface of a core material using a fluidized-bed coating device or the like, heated to form the coating layer on the core material, and then the core material coated with the coating layer may be treated with the polymer precursor in the supercritical fluid and/or subcritical fluid.

-Polymer Precursor-

The polymer precursor is not particularly limited and may be appropriately selected according to the purpose. For example, the polymer precursor is preferably at least one selected from compounds partly having either a five-membered aromatic structure or an aniline structure. The polymer formed from the polymer precursor preferably has electrical conductivity.

The compound partly having a five-membered aromatic structure is not particularly limited and may be appropriately selected according to the purpose. Examples thereof include pyrrole, thiophene, furan, isoindole, isobenzofuran, isobenzothiophene and derivatives thereof Examples of the derivatives thereof include N-methylpyrrole, 3-methylpyrrole, 3-methylthiophene, 3-methylfuran, 3-methylindole and pyrrole dimer. Additionally, oligomers of these compounds can be used.

Examples of the compounds partly having an aniline structure at least include aniline, and aniline compounds in which at least one of the ortho-position and meta-position is substituted by a halogen atom such as chlorine, bromine or iodine atom; an alkyl group such as a methyl group or an ethyl group; an alkoxy group such as a methoxy group or an ethoxy group; and an aryl group such as a phenyl group or a tolyl group. Additionally, oligomers of these compounds can be used.

These compounds can be used alone or in combination.

Of these, pyrrole; pyrrole dimer; pyrrole derivatives such as N-methyl pyrrole, 3-methyl pyrrole; and aniline are particularly preferred because coatings do not change in quality and are stable in air.

-Coating Layer Treatment-

First, the coating layer on the surface of the core material is treated with the polymer precursor in the supercritical fluid and/or the subcritical fluid. The treatment condition of the coating layer is not particularly limited as long as it is capable of allowing the polymer precursor to be finely dispersed in the coating layer and of obtaining a coating layer with excellent conductivity, and may be appropriately selected according to the purpose.

The amount of the polymer precursor is not particularly limited as long as a desired conductive coating layer can be obtained in an oxidation treatment step described below, and may be appropriately selected according to the purpose. For example, the amount of the polymer precursor is preferably 0.005 g to 5 g, and more preferably 0.05 g to 3 g per 1 g of the coating layer. The amount of the polymer precursor within the above range enables to obtain a conductive coating layer having a desired effect. When the amount of the polymer precursor exceeds the amount of the coating layer, the excess polymer precursor can be recycled.

The condition of pressure for treating the coating layer on the surface of the core material with the polymer precursor is not particularly limited as long as the pressure is higher than the critical pressure of the supercritical fluid and/or subcritical fluid, and may be appropriately selected according to the purpose. The pressure is preferably 1 MPa to 60 MPa, and more preferably 5 MPa to 40 MPa.

The temperature at which the coating layer on the surface of the core material is treated is not particularly limited as long as it is higher than the critical temperature of the supercritical fluid and/or subcritical fluid, and may be appropriately selected according to the purpose. For example, it is preferably 35° C. to 90° C., when carbon dioxide is used.

The time for treating the coating layer with the polymer precursor is not particularly limited as long as a desired conductive coating layer can be obtained, and may be appropriately selected depending on the kinds of the coating resin and the amount of the polymer precursor relative to the amount of the coating layer. It is preferably 1 minute to 120 minutes, and more preferably 5 minutes and 60 minutes. Additionally, the treatment may be performed under stirring and by shaking a high pressure vessel, as necessary.

After the coating layer is treated with the polymer precursor, a solvent in the high pressure vessel is gradually discharged and then a treated carrier can be taken out. The thus obtained carrier can be treated with an oxidant. The treatment with an oxidant enables the polymer precursor to be polymerized to form a conductive polymer in the coating layer.

<Oxidation Treatment Step>

The oxidation treatment step is a step in which the coating layer is subjected to oxidation treatment so as to form a polymer from a polymer precursor in the coating layer. The polymer formed from the polymer precursor has conductivity and becomes a conductive material.

Examples of the form in which the polymer formed from the polymer precursor exists include a form in which the polymer exists on the surface of the coating layer, a form in which the polymer partly exists on the surface of the coating layer, a form in which the polymer exists in the coating layer, and combinations thereof. Particularly preferred is a form in which the polymer is uniformly dispersed in the coating layer.

-Oxidant-

The oxidant is not particularly limited as long as it is capable of polymerizing the polymer precursor to form a conductive polymer, and may be appropriately selected according to the purpose. Examples of the oxidants include transition metal chlorides such as ferric chloride and cupric chloride; permanganic acids such as permanganic acid and permanganate; chromium oxides such as chromium trioxide; nitrates such as silver nitrate; halogen atoms such as chlorine, bromine, and iodine; peroxides such as hydrogen peroxide and benzoyl peroxide; peroxyacid compounds such as peroxydisulfuric acid and potassium peroxydisulfate; hypochlorous compounds such as hypochlorous acid, sodium hypochlorite and potassium hypochlorite; and metal oxides such as silver oxide. Of these, transition metal chlorides, halogen atoms, peroxoacid compounds are more preferably used as oxidants because they also function as dopants. These oxidants may be used alone or in combination.

The solvent for dissolving the oxidant is not particularly limited and may be appropriately selected according to the purpose. For example, water may be used. Examples of water include tap water, distilled water and extrapure water. Of these, distilled water and extrapure water are preferably used in terms of chlorine free.

The concentration of the oxidant is not particularly limited as long as the polymer precursor is sufficiently polymerized and may be appropriately selected depending on the kinds of oxidants. For example, in case of ferric chloride, it is preferably 0.02 mol/L to 3.0 mol/L, and more preferably 0.04 mol/L to 2.0 mol/L.

When the coating layer is treated with the oxidant, the temperature and treatment time of an aqueous solution of oxidant are not particularly limited and may be appropriately selected according to the purpose. The temperature is preferably room temperature (approximately 25° C.) to 80° C., and more preferably room temperature (approximately 25° C.) to 60° C. The treatment time may be an appropriate time for sufficiently polymerizing the polymer precursor; the coating layer may be immersed in the oxidant solution for 5 minutes to 120 minutes, and preferably 15 minutes to 60 minutes. Alternatively, the coating layer may be immersed in the oxidant solution under stirring, as necessary.

Whether or not the polymer precursor has been polymerized by means of the oxidation treatment can be confirmed for example by observing color changes in the coating layer. For example, when pyrrole is used as the polymer precursor, pyrrole is polymerized to yield polypyrrole and the color of a coating layer changes to black, thereby allowing confirmation of polymerization of pyrrole. Moreover, formation of the conductive coating layer can be confirmed by measuring electric resistivity.

When the thus obtained carrier, which has been subjected to oxidation treatment, is used as a two-component developer, the carrier preferably has LogR, a measured value of electric resistance, of 7 Ω·cm to 16 Ω·cm. The electrical resistance may be appropriately selected depending on a developing process using a carrier. When it is less than 7 Ω·cm, the carrier brush (magnetic brush) standing on the developer bearing member causes increase and reduction in the image density, which can be readily recognized. The electric resistance of more than 16 Ω·cm may easily cause such troubles as an edge phenomenon in which the image density differs between an edge part and a solid part in an image and/or between a line image and a solid image, decrease in the developing ability due to charge up of carrier, and carrier development (carrier adhesion) in a non-image area.

Here, the electric resistance of a carrier is a value which can be found from current and applied voltage values measured, for example, in such a manner that the carrier is loaded between two electrodes placed in parallel and a potential difference is established between the two electrodes. Specifically, a vessel equipped with electrodes placed in parallel at 2 mm intervals is filled with the carrier, and a direct current resistance when a potential difference between the electrodes is 50V is measured on 4329A HIGH RESISTANCE METER manufactured by Hewlett-Packard Development Co., L.P.

The thickness of the coating layer on the carrier is preferably appropriately adjusted so that electric resistance is set within an appropriate range. Because silicone shrinks its volume on condensation reaction, it has a disadvantage that uneven reaction occurs inside the coating layer as the coating layer becomes thicker. Thus, the coating layer preferably has a thickness of 1.0 μm or less, and more preferably 0.02 μm to 0.8 μm.

The thickness of the coating layer is measured by observing a cross-section of the carrier on a transmission electron microscope (TEM).

(Developer)

The developer of the present invention is a two-component developer containing the carrier of the present invention and a toner.

The toner and carrier are preferably contained in the developer in amounts of 1.0 part by mass to 10.0 parts by mass of the toner relative to 100 parts by mass of the carrier.

The toner contains at least a binder resin and a colorant, and also contains a releasing agent, a charge control agent, and other components as necessary.

<Toner>

A method for producing the toner is not particularly limited and any production method may be appropriately selected according to the purpose, and examples thereof include a pulverization method and a suspension polymerization method, an emulsion polymerization method, and a polymer suspension method for forming toner base particles by emulsifying, suspending or flocculating an oil phase in an aqueous medium.

-Binder Resin-

The binder resin is not particularly limited and may be appropriately selected from ones known according to the purpose. Examples thereof include homopolymers of styrene or substitution products of styrene such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-methyl α-chlormethacrylate copolymers, styrene-acrylonitrile copolymers, styrene-vinylmethylether copolymers, styrene-vinylmethylketone copolymers, styrene-butadiene copolymers, styrene-isopropyl copolymers, and styrene-maleic ester copolymers; polymethylmethacrylate resins, polybutylmethacrylate resins, polyvinyl chloride resins, polyvinyl acetate resins, polyethylene resins, polyester resins, polyurethane resins, epoxy resins, polyvinylbutyral resins, polyacrylic resins, rosin resins, modified rosin resins, terpene resins, phenol resins, aliphatic hydrocarbon resins, aromatic hydrocarbon resins, and aromatic petroleum resins. These may be used alone or in combination.

-Colorant-

The colorant is not particularly limited and any colorant may be appropriately selected from known dyes and pigments according to the purpose. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, vermilion lead, cadmium red, cadmium mercury red, antimony vermilion, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These may be used alone or in combination.

The amount of the colorant in the toner is preferably 1% by mass to 15% by mass, and more preferably 3% by mass to 10% by mass.

The colorant may be used as a master batch being combined with a resin. The resin is not particularly limited and any resin may be appropriately selected from ones known according to the purpose. Examples thereof include polymers of styrene or substitution products thereof, styrene copolymers, polymethyl methacrylate resins, polybuthyl methacrylate resins, polyvinyl chloride resins, polyvinyl acetate resins, polyethylene resins, polypropylene resins, polyester resins, epoxy resins, epoxy polyol resins, polyurethanes, polyamides, polyvinyl butyrals, polyacrylic resins, rosins, modified rosins, terpene resins, aliphatic hydrocarbon resins, alicyclic hydrocarbon resins, aromatic petroleum resins, chlorinated paraffin, and paraffin. These may be used alone or in combination.

-Releasing Agent-

The releasing agent is not particularly limited and may be appropriately selected from known releasing agents according to the purpose. Examples thereof include waxes.

Examples of waxes include carbonyl group-containing waxes, polyolefin waxes, and long-chain hydrocarbons. These may be used alone or in combination. Of these, carbonyl group-containing waxes are preferable.

The carbonyl group-containing waxes include, for example, polyalkanoic acid esters, polyalkanol esters, polyalkanoic acid amides, polyalkyl amides, and dialkyl ketones. The polyalkanoic acid esters include, for example, carnauba wax, montan wax, trimethylolpropane tribehenate, pentaerythritol tetrabehenate, pentaerythritol diacetate dibehenate, glycerin tribehenate, 1,18-octadecanediol distearate and the like. The polyalkanol esters include, for example, tristearyl trimellitate, and distearyl maleate. The polyalkanoic acid amides include, for example, dibehenyl amide. The polyalkyl amides include, for example, tristearylamide trimellitate. The dialkyl ketones include, for example, distearyl ketone. Of these, carbonyl group-containing waxes, polyalkanoic acid esters are particularly preferable.

The polyolefin waxes include, for example, polyethylene waxes, and polypropylene waxes.

The long-chain hydrocarbons include, for example, paraffin waxes, and Sasol Wax.

The melting point of the releasing agent is not particularly limited and may be appropriately selected according to the purpose. It is preferably 40° C. to 160° C., more preferably 50° C. to 120° C., and still more preferably 60° C. to 90° C. When the melting point is less than 40° C., the wax may adversely affect heat-resisting storage ability, and when the melting point is more than 160° C., it is liable to cause cold offset at the time of fixing at low temperature.

The melt viscosity of the releasing agent is preferably 5 cps to 1,000 cps, and more preferably 10 cps to 100 cps as a measurement at a temperature higher by 20° C. than the melting point of the wax. When the melt viscosity is less than 5 cps, releasability may be poor, and when the melt viscosity is more than 1,000 cps, enhancing effects on hot-offset resistance and low-temperature fixing ability may not be obtained.

The amount of the releasing agent in the toner is not particularly limited and may be appropriately selected according to the purpose. It is preferably 1% by mass to 40% by mass, and more preferably 3% by mass to 30% by mass.

When the amount is more than 40% by mass, fluidity of the toner may be poor.

-Charge Control Agent-

The charge control agent is not particularly limited and a positive or negative charge control agent may be appropriately selected and used according to the polarity of charge on the photoconductor.

As the negative charge control agent, for example, resins or compounds having electron-donating functional groups, azo dyes, organometallic complexes, and the like can be used. Specific examples thereof include BONTRON (product number: S-31, S-32, S-34, S-36, S-37, S-39, S-40, S-44, E-81, E-82, E-84, E-86, E-88, A, 1-A, 2-A, 3-A) (all manufactured by Orient Chemical Industries, Ltd.); KAYACHARGE (product number: N-1, N-2), KAYASET BLACK (product number: T-2, 004) (all manufactured by Nippon Kayaku Co., Ltd.); AIZEN SPILON BLACK (T-37, T-77, T-95, TRH, TNS-2) (all manufactured by HODOGAYA CHEMICAL CO., LTD.); and FCA-1001-N, FCA-1001-NB, and FCA-1001-NZ (all manufactured by Fujikura Kasei Co., Ltd.).

As the positive charge control agent, for example, basic compounds such as nigrosine dyes, cationic compounds such as quaternary ammonium salts, metal salts of higher fatty acids, and the like can be used. Specific Examples thereof include BONTRON (product number: N-01, N-02, N-03, N-04, N-05, N-07, N-09, N-10, N-11, N-13, P-51, P-52, AFP-B) (all manufactured by Orient Chemical Industries, Ltd.); TP-302, TP-415, TP-4040 (all manufactured by HODOGAYA CHEMICAL CO., LTD.); Copy Blue PR, Copy Charge (product number: PX-VP-435, NX-VP-434) (all manufactured by Hoechst AG); FCA (product number: 201, 201-B-1, 201-B-2, 201-B-3, 201-PB, 201-PZ, 301) (all manufactured by Fujikura Kasei Co., Ltd.); and PLZ (product number: 1001, 2001, 6001, 7001) (all manufactured by SHIKOKU CHEMICALS CORPORATION). These may be used alone or in combination.

The amount of the charge control agent to be added is determined depending on the toner production method including the type and dispersing method of the binder resin, and is not uniquely limited. It is preferably 0.1 parts by mass to 10 parts by mass, and more preferably, 0.2 parts by mass to 5 parts by mass relative to 100 parts by mass of the binder resin. When the amount is more than 10 parts by mass, the charging ability of the toner becomes so high that the effect of the charge control agent is reduced, thus the electrostatic attraction force with the developing roller increases and the fluidity of the developer and image density may decrease. When the amount is less than 0.1 parts by mass, the charge rising ability and the amount of charge are insufficient, which may adversely affect the toner image.

As toner materials, in addition to the binder resin, the releasing agent, the colorant and the charge control agent, inorganic fine particles, a fluidity improver, a cleanability improver, a magnetic material, a metal soap, and the like may be added as necessary.

As the inorganic fine particles, for example, silica, titania, alumina, cerium oxide, strontium titanate, calcium carbonate, magnesium carbonate, calcium phosphate, and the like may be used, and it is more preferable to use silica fine particles hydrophobized by silicone oil or hexamethyldisilazane and titanium oxide applied with a specific surface treatment.

Examples of silica fine particles include AEROSIL (product number: 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, REA200) (all manufactured by NIPPON AEROSIL CO., LTD.); HDK (product number: H20, H2000, H3004, H2000/4, H2050EP, H2015EP, H3050EP, KHD50), HVK2150 (all manufactured by Wacker Chemical AG); CAB-O-SIL (product number: L-90, LM-130, LM-150, M-5, PTG, MS-55, H-5, HS-5, EH-5, LM-150D, M-7D, MS-75D, TS-720, TS-610, TS-530) (all manufactured by Cabot Corporation), and the like can be used.

The amount of the inorganic fine particles to be added is preferably 0.1 parts by mass to 5.0 parts by mass, and more preferably 0.8 parts by mass to 3.2 parts by mass relative to 100 parts by mass of toner base particles.

A method for manufacturing the toner is not particularly limited and may be appropriately selected according to the purpose. Examples thereof include a pulverization method, a polymerization method (a suspension polymerization method, an emulsion polymerization method) for directly polymerizing specific crystalline macromolecules and monomer compositions containing polymerizable monomers in an aqueous phase, a polyaddition reaction method for directly elongating or crosslinking specific crystalline macromolecules and compositions containing isocyanate group-containing prepolymers with amines in an aqueous phase, a polyaddition reaction method using isocyanate group-containing prepolymers, a method for dissolving by a solvent and removing the solvent for pulverization, and a melt spray method.

The pulverization method is a method for obtaining base particles of the toner by, for example, melting or kneading, pulverizing, and classifying toner materials. In the pulverization method, for the purpose of improving average circularity of the toner, mechanical impacts may be applied to the obtained toner base particles to control the shapes. In this case, the mechanical impacts can be applied to the toner base particles by use of, for example, an apparatus such as a hybridizer or a mechanofusion system.

The above toner materials are mixed, and the mixture is charged in a melt kneader for melt kneading. As the melt kneader, for example, a single-screw continuous kneader, a twin-screw continuous kneader, or a batch kneader by a roll mill can be used. For example, a twin-screw extruder Model KTK manufactured by Kobe Steel, Ltd., an extruder Model TEM manufactured by Toshiba Machine Co., Ltd., a twin-screw extruder manufactured by KCK, Co., Ltd., a twin-screw extruder Model PCM manufactured by Ikegai Iron Works, Ltd., Ko-Kneader manufactured by Buss AG, or the like is suitably used. It is preferable to carry out the melt kneading under proper conditions so as not to cause a molecular chain breaking of the binder resin. Specifically, the melt kneading is carried out at a temperature with reference to a softening point of the binder resin, severe breaking may occur when the temperature is excessively higher than the softening point, and dispersion may not progress when the temperature is excessively low.

In the pulverization, the kneaded mixture obtained by the kneading is pulverized. It is preferable to first coarsely pulverize and then finely pulverize the kneaded mixture. In this case, preferably used are pulverization methods such as pulverization by making the kneaded mixture collide with a collision plate in a jet stream, pulverization by making particles collide with each other in a jet stream, and pulverization in a narrow gap between a mechanically rotating rotor and a stator.

In the classification, the pulverized products obtained from the pulverization are classified and adjusted into particles having a predetermined particle diameter. The classification can be carried out by removing fine particles by, for example, cyclone separation, decantation, centrifugal separation, or the like.

After completion of the pulverization and classification, the pulverized products are classified in an air stream by a centrifugal force and the like to produce toner particles having a predetermined particle diameter.

In the suspension polymerization method, a colorant, a releasing agent, and the like are dispersed in an oil-soluble polymerization initiator and polymerizable monomers, and these are emulsified and dispersed by an emulsification method to be described later in an aqueous medium containing a surfactant and other agents such as a solid dispersing agent. Then, after a polymerization reaction to produce particles, a wet process may be performed for adhering inorganic fine particles to the toner particle surfaces in the present invention. At that time, it is preferable to apply the process to toner particles from which an excessive surfactant and the like has been removed by washing.

Examples of the polymerizable monomers include acids such as acrylic acid, methacrylic acid, α-cyanoacrylic acid, α-cyanomethacrylic acid, itaconic acid, crotonic acid, fumaric acid, maleic acid, and maleic anhydride; acrylamide, methacrylamide, diacetoneacrylamide, and methylol compounds thereof, vinylpyridine, vinylpyrrolidone, vinylimidazole, ethyleneimine, and dimethylaminoethyl methacrylate.

In addition, functional groups can be introduced by selecting, as the dispersing agent to be used, one having acidic groups or basic groups and thereby the dispersing agent is made to absorb and remain on the particle surfaces.

In the emulsion polymerization method, a water-soluble polymerization initiator and polymerizable monomers are emulsified in water using a surfactant, and latex is synthesized by a general method for emulsion polymerization. Separately, a colorant, a releasing agent, and the like are dispersed in an aqueous medium to prepare a dispersion, the dispersion is mixed, and the latex particles are then aggregated into a toner particle size, heated and melted to bond with one another to produce toner particles. Subsequently, a wet process of inorganic fine particles to be described later may be performed. Functional groups can be introduced to the toner particle surfaces by using monomers similar to those used for the suspension polymerization method as latex.

Of these, because of high selectivity of resins, high low-temperature fixing ability, excellent granulation ability, and easiness in controlling particle diameter, particle size distribution, and shapes, preferably used as the toner is one obtained by preparing a toner solution by dissolving and/or dispersing, in an organic solvent, a toner material containing active hydrogen group-containing compounds and polymers capable of reacting with the active hydrogen group-containing compounds, and then preparing a dispersion by emulsifying and/or dispersing the toner solution in an aqueous solution, making, in the aqueous medium, the active hydrogen group-containing compounds react with polymers capable of reacting with the active hydrogen group-containing compounds to produce an adhesive base material in particulate forms, and removing the organic solvent.

The toner material contains at least an adhesive base material obtained by reacting together an active hydrogen group-containing compound, a polymer capable of reacting with the active hydrogen group-containing compound, a binder resin, a charge control agent, and a colorant, and further contains other components such as resin fine particles, and a releasing agent as necessary.

In addition, in order to improve fluidity, storage ability, developing ability, and transferability of the toner, the thus produced toner base particles may be added and mixed with inorganic particles such as hydrophobic silica fine powder. A common powder mixer is used to mix an additive, and it is preferable to equip a jacket or the like to adjust the temperature inside. Here, in order to change the history of a stress applied to the additive, the additive may be added in the middle or gradually. In this case, the number of revolutions, rolling speed, time, temperature, and the like of the mixer may be changed. Alternatively, first, a strong stress and then a relatively weak stress may be added, and vice versa. Examples of available mixing equipments include a V-form mixer, a Rocking mixer, a Loedige mixer, a Nauta mixer, and a HENSCHEL MIXER. Next, coarse particles and aggregated particles are removed by sieving with a screen of 250 mesh or more, and thus a toner can be obtained.

Although the toner is not particularly limited in terms of the shape and size thereof and may be appropriately selected according to the purpose. The toner preferably has the following average circularity, volume-average particle diameter, ratio between the volume-average particle diameter and number-average particle diameter (volume-average particle diameter/number-average particle diameter), and the like.

The average circularity is a value obtained by dividing a perimeter of an equivalent circle equal in the projected area to the toner shape by a perimeter of a real particle, and this is preferably 0.900 to 0.980, and more preferably 0.950 to 0.975. The toner containing particles having an average circularity of less than 0.94 at 15% or less is preferable.

When the average circularity is less than 0.900, satisfactory transferability and a high quality image without dust may not be obtained, and when it is more than 0.980, in an image forming system employing blade cleaning or the like, there is a possibility that a cleaning defect occurs on the photoconductor, transfer belt, and the like. The cleaning defect causes image smears, for example, in the case of formation of an image with a high image area ratio such as a photographic image, background smears as a result of toner that has formed an untransferred image due to a paper feed defect and the like being accumulated as a residual untransferred toner on the photoconductor or contaminates the charge roller that contact-charges the photoconductor to disable the charge roller from exhibiting original charging ability.

The average circularity is measured by use of a flow-type particle image analyzer ("FPIA-2100," manufactured by SYSMEX CORPORATION) and analyzed by use of analysis software (FPIA-2100 Data Processing Program for FPIA version 00-10). Specifically, in a 100 ml glass beaker, 0.1 ml to 0.5 ml of a 10% by mass surfactant (alkylbenzene sulfonate, NEOGEN SC-A, manufactured by Daiichi Kogyo Seiyaku Co., Ltd.) is loaded, then 0.1 g to 0.5 g of a toner is added and stirred with a microspatula, and then 80 ml of ion exchange water is added. The thus obtained dispersion is dispersed in an ultrasonic dispersing machine (manufactured by Honda Electronics Co., Ltd.) for 3 minutes. The shape and distribution of the toner of the dispersion are measured on the analyzer FPIA-2100 until a concentration of 5,000 particles/μl to 15,000 particles/μl is obtained. In this measurement method, it is important to control the dispersion concentration to 5,000 particles/μl to 15,000 particles/μl from the point of measurement reproducibility of average circularity. In order to obtain the dispersion concentration, it is necessary to change the conditions of the dispersion, that is, the amount of the surfactant and the amount of the toner to be added. Similar to the measurement of the toner particle diameter described above, the amount of the surfactant to be required differs depending on hydrophobicity of the toner, noise due to bubbles occurs when a large amount of the surfactant is added, while it is impossible to sufficiently moisten the toner when the amount is small, which brought in insufficient dispersion. In addition, the amount of the toner to be added differs depending on the particle diameter, the amount is small with a small particle diameter, while it is necessary to increase the amount with a large particle diameter. When the toner has a particle diameter of 3 μm to 10 μm, the dispersion concentration can be adjusted to 5,000 particles/μl to 15,000 particles/μl by adding 0.1 g to 0.5 g of the toner.

Although the volume-average particle diameter of the toner is not particularly limited and may be appropriately selected according to the purpose. It is preferably 3 μm to 10 μm, and more preferably 3 μm to 8 μm.

In the two-component developer, when the toner has a volume-average particle diameter of less than 3 μm, the toner may be melted and bonded to the surface of carrier as a result of a long-term stirring in a developing device, and charging ability of the carrier may be poor; and when it has a volume-average particle diameter of more than 10 μm, a high resolution and high quality image may be hard to obtain, and the particle diameter of the toner may greatly vary when the toner is consumed and replenished in the developer.

The ratio of the volume-average particle diameter to the number-average particle diameter (volume-average particle diameter/number-average particle diameter) in the toner is preferably 1.00 to 1.25, and more preferably 1.10 to 1.25.

The volume-average particle diameter and the ratio of the volume-average particle diameter to the number-average particle diameter (volume-average particle diameter/number-average particle diameter) are measured at an aperture diameter of 100 μm on a particle size analyzer ("Multisizer III," manufactured by Beckman Coulter, Inc.), and are analyzed by an analysis software (Beckman Coulter Multisizer 3 Version 3.51). Specifically, in a 100 ml glass beaker, 0.5 ml of a 10% by mass surfactant (alkylbenzene sulfonate, NEOGEN SC-A, manufactured by Daiichi Kogyo Seiyaku Co., Ltd.) is loaded, then 0.5 g of a toner is added thereto and stirred with a microspatula, and then 80 ml of ion exchange water is added. The thus obtained dispersion is dispersed in an ultrasonic dispersing machine (W-113MK-II, manufactured by Honda Electronics Co., Ltd.) for 10 minutes. Using Isoton III (manufactured by Beckman Coulter, Inc.) as a solution for measurement, properties of the dispersion are measured on the Multisizer III. The measurement is performed by dropping the toner sample dispersion such that the concentration thereof indicates by the analyzer reaches 8±2%. In the present measuring method, it is important to control the concentration of the toner sample dispersion to 8±2% from the point of measurement reproducibility of the particle diameter. Within this concentration range, no particle diameter variations occur.

Coloring of the toner is not particularly limited and may be appropriately selected according to the purpose. This can be provided as at least one selected from a black toner, a cyan toner, a magenta toner, and a yellow toner. The respective color toners can be obtained by appropriately selecting the types of the colorants, and a color toner is preferably used.

<Developer Container>

The developer container is a container that contains the developer of the present invention.

The container is not particularly limited and may be appropriately selected from known containers according to the purpose. Examples thereof include a container having a developer container body and a cap.

The developer container body is not particularly limited in size, shape, structure, material, and the like, and may be appropriately selected according to the purpose. For example, the shape is preferably a cylindrical shape and the like, and particularly preferably one having spiral projections and depressions formed at the inner circumferential surface, allowing a developer as the contents to move to an ejection opening side by being rotated, and having a bellows function at a part or the whole of the spiral parts.

The material of the developer container body is not particularly limited and one excellent in dimensional accuracy is preferable. Suitable example include resins, and of these, examples thereof include a polyester resin, a polyethylene resin, a polypropylene resin, a polystyrene resin, a polyvinylchloride resin, a polyacrylate resin, a polycarbonate resin, an ABS resin and a polyacetal resin.

The developer container is easily stored and conveyed, is excellent in handling ability, and can be suitably used to feed a developer while being detachably attached to the process cartridge and the image forming apparatus and the like to be described later.

<Process Cartridge>

A process cartridge used in the present invention includes at least a latent electrostatic image bearing member configured to support a latent electrostatic image and a developing unit configured to develop a latent electrostatic image borne on the latent electrostatic image bearing member using a developer to form a visible image, and further includes other units appropriately selected as necessary.

The developing unit includes at least a developer container configured to contain the developer of the present invention and a developer bearing member configured to bear and convey the developer contained in the developer container, and may further include a layer thickness control member configured to control the layer thickness of the toner to be borne on the developer bearing member, as necessary.

The process cartridge of the present invention can be detachably equipped in various image forming apparatuses of electrophotography, and is preferably detachably equipped in the image forming apparatus used in the present invention to be described later.

Figure 2:
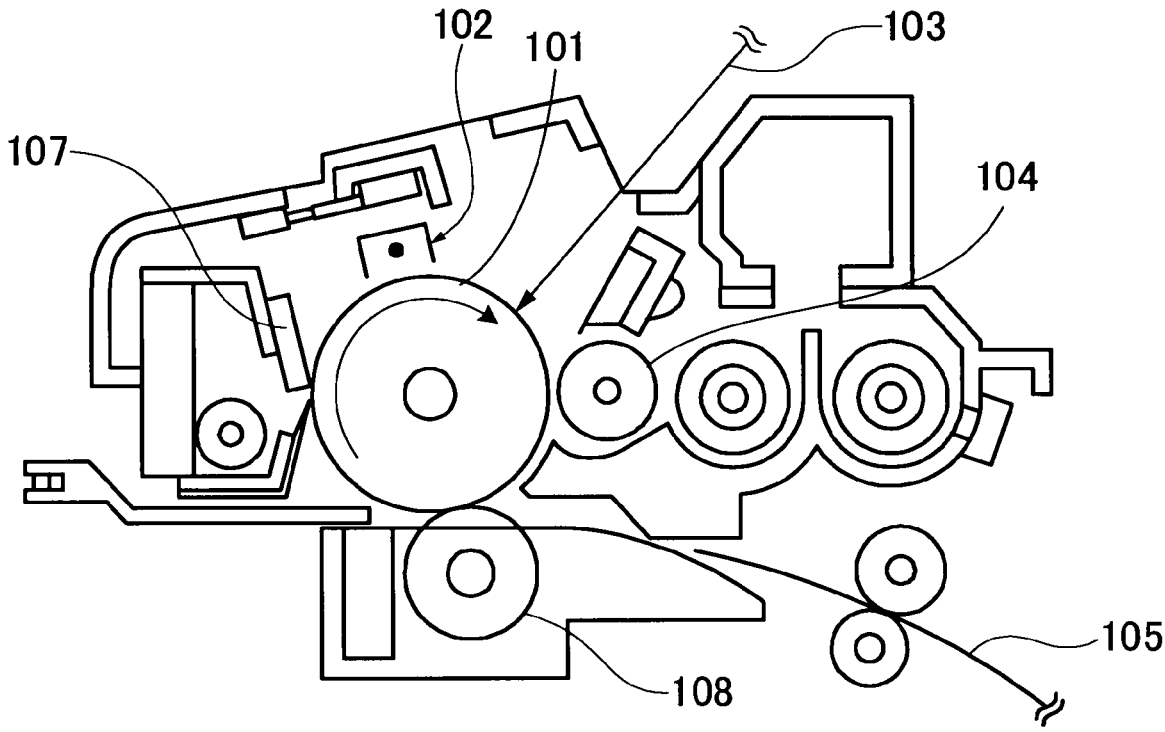
FIG. 2 is a schematic configuration view showing an example of a process cartridge used in the present invention.

Here, the process cartridge, for example, as shown in FIG. 2, houses a photoconductor 101, includes a charging unit 102, a developing unit 104, a transferring unit 108, and a cleaning unit 107, and further includes other members as necessary. Reference numeral 103 in FIG. 2 denotes exposure by an exposing unit, for which a light source capable of writing at a high resolution is used. Reference numeral 105 denotes a recording medium. As the photoconductor 101, one the same as that of the image forming apparatus to be described later can be used. For the charging unit 102, any charging member can be used.

Next, an image forming process conducted by the process cartridge of FIG. 2 will be described. While the photoconductor 101 rotates in the arrow direction, a latent electrostatic image corresponding to an exposure image is formed on the surface of the photoconductor by charging by the charging unit 102 and exposure 103 by the exposing unit (not shown). This latent electrostatic image is developed using a toner by the developing unit 104, and the developed toner image is transferred by the transferring unit 108 to the recording medium 105 and is printed. Subsequently, after the image is transferred to the recording medium the photoconductor surface is cleaned by the cleaning unit 107, and is further charge eliminated by a charge eliminating unit (not shown), and the above operations are repeated.

(Image Forming Method and Image Forming Apparatus)

An image forming method used in the present invention includes at least a latent electrostatic image forming step, a developing step, a transferring step, and a fixing step, and further includes other steps, for example, a charge eliminating step, a cleaning step, a recycling step, a controlling step, and the like, appropriately selected as necesssary.

An image forming apparatus used in the present invention includes at least a latent electrostatic image bearing member, a latent electrostatic image forming unit, a developing unit, a transferring unit, and a fixing unit, and further includes other units, for example, a charge eliminating unit, a cleaning unit, a recycling unit, a controlling unit, and the like, appropriately selected as necessary.

The latent electrostatic image forming step is a step of forming a latent electrostatic image on the latent electrostatic image bearing member.

The latent electrostatic image bearing member (sometimes referred to as "electrophotographic photoconductor" or "photoconductor") is not particularly limited in material, shape, structure, size, and the like, and may be appropriately selected from known ones. The shape is preferably a drum shape, and examples of the material include amorphous silicon and selenium of inorganic photoconductors and polysilane and phthalopolymethine of organic photoconductors (OPC). Of these, amorphous silicon or the like is preferable from the point of a long life span.

The latent electrostatic image can be formed by, for example, uniformly charging the surface of the latent electrostatic image bearing member and then exposing its surface imagewise by the latent electrostatic image forming unit. The latent electrostatic image forming unit includes at least, for example, a charger that uniformly charges the surface of the latent electrostatic image bearing member and an exposurer that exposes the surface of the latent electrostatic image bearing member imagewise.

The charging can be carried out by, for example, applying voltage to the surface of the latent electrostatic image bearing member by use of the charger.

The charger is not particularly limited and may be appropriately selected according to the purpose. Examples thereof include a contact charger which is known by itself provided with a conductive or semiconductive roll, brush, film, rubber blade, or the like, and a noncontact charger using a corona discharge such as a corotron or scorotron.

As the charger, preferred is one that is arranged in contact or non-contact with the latent electrostatic image bearing member and charges the surface of the latent electrostatic image bearing member by superposedly applying direct current and alternating current voltages.

In addition, the charger is preferably a charging roller that is arranged in proximity and non-contact with the latent electrostatic image bearing member via a gap tape and charges the surface of the latent electrostatic image bearing member by superposedly applying direct current and alternating current voltages to the charging roller.

The exposure can be carried out by, for example, exposing the surface of the latent electrostatic image bearing member imagewise by use of the exposurer.

The exposurer is not particularly limited as long as it is capable of exposing imagewise on the surface of the latent electrostatic image bearing member which has been charged by the charger and may be appropriately selected according to the purpose. Examples thereof include various exposurers such as a copying optical system, a rod lens array system, a laser optical system, and a liquid crystal shutter optical system.

Here, in the present invention, a backlight system for exposing the latent electrostatic image bearing member imagewise from the rear surface side may be employed.

-Developing Step and Developing Unit-

The developing step is a step of developing the latent electrostatic image using the developer of the present invention so a to form a visible image.

The visible image can be formed by, for example, developing the latent electrostatic image using the developer of the present invention by the developing unit.

The developing unit is not particularly limited, for example, as long as it is capable of developing using the developer of the present invention and may be appropriately selected from known ones. For example, one that includes at least a developing device that contains the developer of the present invention and is capable of supplying the developer to the latent electrostatic image in a contact or noncontact manner is preferable, and a developing device equipped with the developer container is more preferable.

The developing device can employ either a dry developing system or a wet developing system, and can be either a single-color developing device or a multi-color developing device.

Examples thereof include one including a stirrer that frictionally stirs the developer so as to be charged and a rotatable magnet roller.

In the developing device, for example, the toner and the carriers are mixed and stirred, the toner is charged by friction at that time and is held in a standing state on the surface of the rotating magnet roller to form a magnetic brush. Since the magnet roller is arranged in the vicinity of the latent electrostatic image bearing member (photoconductor), a part of the toner constituting the magnetic brush formed on the surface of the magnet roller is moved to the surface of the latent electrostatic image bearing member (photoconductor) by an electrical suction force. As a result, the latent electrostatic image is developed with the toner to form a visible toner image on the surface of the latent electrostatic image (photoconductor).

The developing device contains the developer of the present invention.

-Transferring Step and Transferring Unit-

The transferring step is a step of transferring the visible image to a recording medium. It is preferable to primarily transfer the visible image onto the intermediate transfer medium using an intermediate transfer medium, and then secondarily transfer the visible image onto the recording medium, and it is more preferable that the transferring step includes a primary transfer step of transferring the visible image onto the intermediate transfer medium to form a compound transfer image using toners of two or more colors, preferably, full-color toners, and a secondary transfer step of transferring the compound transfer image onto a recording medium.

The transfer is carried out by, for example, charging the visible image onto the latent electrostatic image bearing member (photoconductor) using a transfer charger by means of the transferring unit. The transferring unit preferably includes a primary transferring unit configured to transfer the visible image onto the intermediate transfer medium to form a compound transfer image and a secondary transferring unit configured to transfer the compound transfer image onto the recording medium.

The intermediate transfer medium is not particularly limited and may be appropriately selected from ones known according to the purpose, and examples thereof include a transfer belt.

The transferring unit (the primary transferring unit and the secondary transferring unit) preferably includes at least a transfer device that separates and charges the visible image formed on the latent electrostatic image bearing member (photoconductor) onto the recording medium side. One or a plurality of transferring units may be provided.

Examples of the transfer devices include a corona transfer device using corona discharge, a transfer belt, a transfer roller, a pressure transfer roller, and an adhesion transfer device.

Here, the recording medium is not particularly limited and may be appropriately selected from known recording media (recording paper).

The fixing step is a step of fixing the transferred visible image onto the recording medium using a fixing device, and this may be carried out for developers of respective colors every time these are transferred to the recording medium or may be simultaneously carried out for the developers of respective colors in a laminated state at a time.

The fixing device is not particularly limited and may be appropriately selected according to the purpose, for example, a known heating pressure unit is preferably used. Examples of the heating pressure units include a combination of a heating roller and a pressure roller, and a combination of a heating roller, a pressure roller and an endless belt.

The fixing device is preferably a unit that includes a heater with a heating element, a film that contacts with the heater, and a pressure member that pressure-contacts with the heater via the film and configured to fix an unfixed image formed on a recording medium by heating while passing through between the film and the pressure member. Usually, heating by the heating pressure unit is preferably at 80° C. to 200° C.

In the present invention, for example, a known optical fixing device may be used in combination with the fixing step and fixing unit or in place of these.

The charge eliminating step is a step of charge eliminating by applying a charge eliminating bias to the latent electrostatic image bearing member by a charge eliminating unit.

The charge eliminating unit is not particularly limited and is satisfactory as long as it is capable of applying a charge eliminating bias to the latent electrostatic image bearing member, and may be appropriately selected from known charge eliminating devices. Examples thereof include charge eliminating lamps.

The cleaning step is a step of removing the toner remaining on the latent electrostatic image bearing member and preferably carried out by a cleaning unit.

The cleaning unit is not particularly limited and is satisfactory as long as it is capable of removing the toner remaining on the latent electrostatic image bearing member, and may be appropriately selected from known cleaners. Examples thereof include a magnetic brush cleaner, an electrostatic brush cleaner, a magnetic roller cleaner, a blade cleaner, a brush cleaner, and a web cleaner.

The recycling step is a step of recycling the toner removed by the cleaning step to the developing unit, and can be preferably carried out by a recycling unit.

The recycling unit is not particularly limited and may be appropriately selected from known conveying units.

The controlling step is a step of controlling the respective steps, and can be preferably controlled by a controlling unit.

The controlling unit is not particularly limited as long as it is capable of controlling operations of the respective units, and may be appropriately selected according to the purpose. Examples thereof include such devices as sequencers and computers.

Hereinafter, an aspect in which the image forming method in the present invention is carried out by the above-mentioned image forming apparatus will be explained with reference to FIG. 3. An image forming apparatus 100 as shown in FIG. 3 includes a photoconductor drum 10 (hereinafter, referred to as "photoconductor 10") serving as the latent electrostatic image bearing member, a charging roller 20 serving as the charging unit, exposure 30 by means of an exposing device serving as the exposing unit, a developing device 40 serving as the developing unit, an intermediate transfer medium 50, a cleaning device 60 serving as the cleaning unit having a cleaning blade, and a charge eliminating lamp 70 serving as the charge eliminating unit.

The intermediate transfer medium 50 is an endless belt, which is stretched around three rollers 51 so as to be movable in the arrow direction. A part of the three rollers 51 also functions as a transfer bias roller that is capable of applying a predetermined transfer bias (primary transfer bias) to the intermediate transfer medium 50. For the intermediate transfer medium 50, arranged in the vicinity thereof is a cleaning device 90 having a cleaning blade, and arranged opposing thereto is a transfer roller 80 serving as the transferring unit capable of applying a transfer bias to transfer (secondary transfer) a visible image (toner image) onto a transfer sheet 95. Around the intermediate transfer medium 50, arranged is a corona charger 58 for applying a charge to the visible image on the intermediate transfer medium 50, in the rotating direction of the intermediate transfer medium 50, between a contact portion between the photoconductor 10 and the intermediate transfer medium 50 and a contact portion between the intermediate transfer medium 50 and the transfer sheet 95.

The developing device 40 consists of a developing belt 41 serving as the developer bearing member and a black development unit 45K, a yellow development unit 45Y, a magenta development unit 45M, and a cyan development unit 45C provided side by side around the developing belt 41. The black development unit 45K includes a developer containing portion 42K, a developer feed roller 43K, and a developing roller 44K. The yellow development unit 45Y includes a developer containing portion 42Y, a developer feed roller 43Y, and a developing roller 44Y. The magenta development unit 45M includes a developer containing portion 42M, a developer feed roller 43M, and a developing roller 44M. The cyan development unit 45C includes a developer containing portion 42C, a developer feed roller 43C, and a developing roller 44C. In addition, the developing belt 41 is an endless belt, which is rotatably stretched around a plurality of belt rollers and a part of which contacts with the photoconductor 10.

Figure 3:
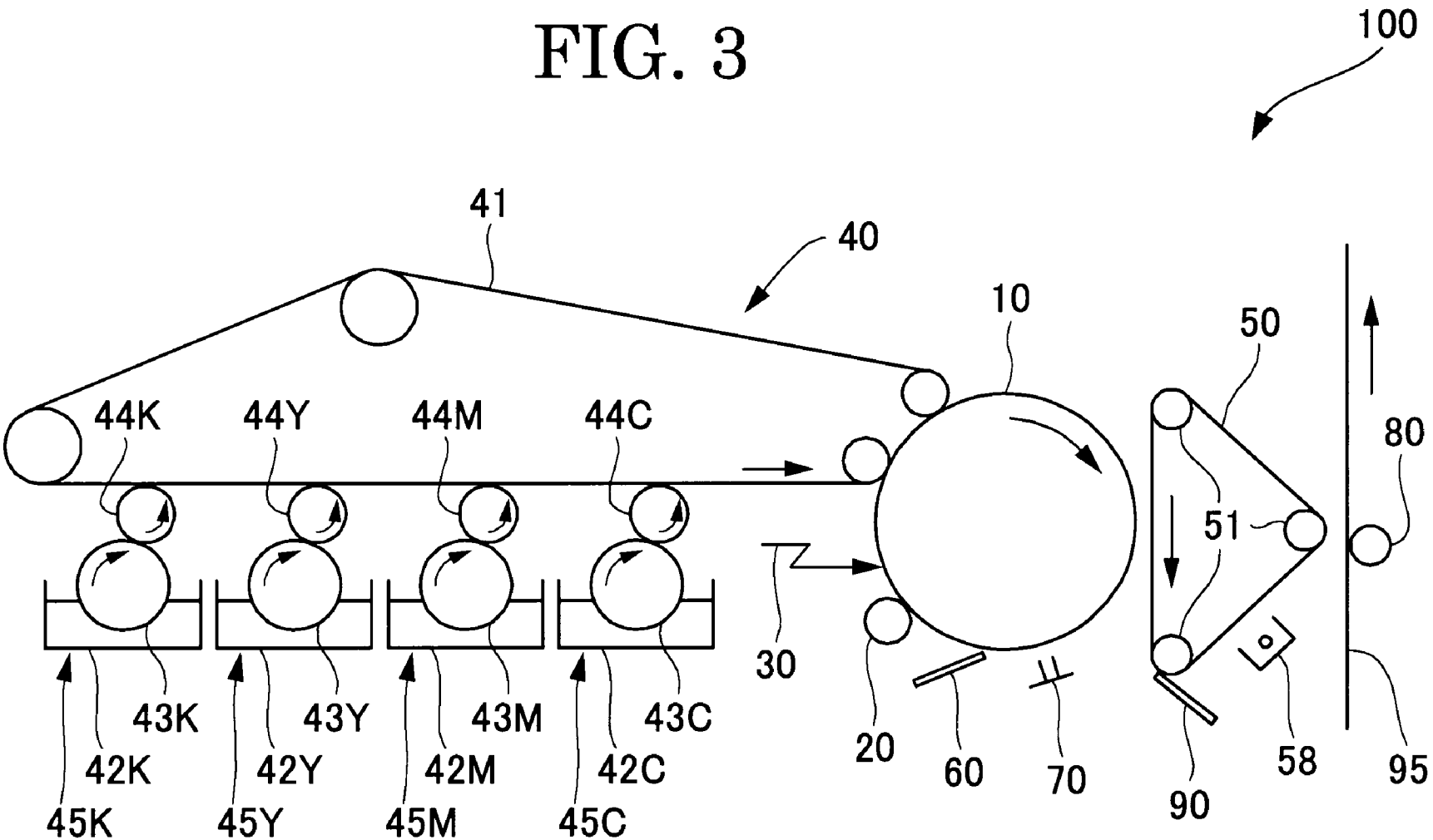
FIG. 3 is a schematic explanatory view showing an example to carry out an image forming method in the present invention by an image forming apparatus used in the present invention.

In the image forming apparatus 100 as shown in FIG. 3, for example, the charging roller 20 uniformly charges the photoconductor drum 10. The exposing device carries out exposure 30 imagewise on the photoconductor drum 10 to form a latent electrostatic image. The latent electrostatic image formed on the photoconductor drum 10 is developed by feeding a toner from the developing device 40 to form a visible image (toner image). The visible image (toner image) is transferred (primary transfer) onto the intermediate transfer medium 50 by a voltage applied from the rollers 51 and is further transferred (secondary transfer) onto the transfer sheet 95. As a result, a transfer image is formed on the transfer sheet 95. Here, a residual toner on the photoconductor 10 is removed by the cleaning device 60, and charging on the photoconductor 10 is once removed by the charge eliminating lamp 70.

Figure 4:
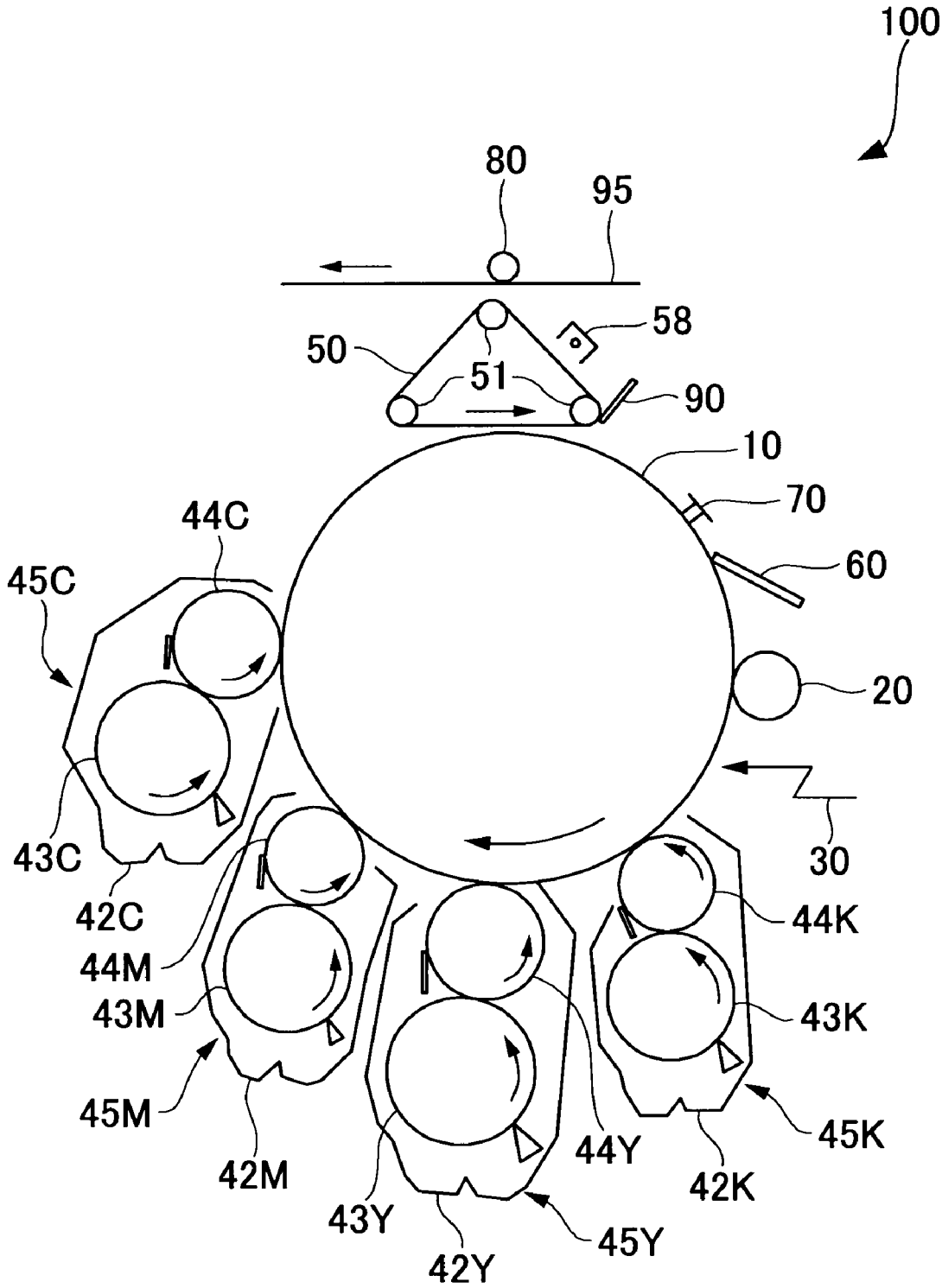
FIG. 4 is a schematic explanatory view showing another example to carry out an image forming method in the present invention by an image forming apparatus used in the present invention.

Another aspect for carrying out the image forming method in the present invention by means of an image forming apparatus used in the present invention will be described with reference to FIG. 4. An image forming apparatus 100 as shown in FIG. 4 has the same configuration as that of the image forming apparatus 100 as shown in FIG. 3, except that no developing belt 41 in the image forming apparatus 100 as shown in FIG. 3 is provided and a black development unit 45K, a yellow development unit 45Y, a magenta development unit 45M, and a cyan development unit 45C are arranged around the photoconductor 10 in a directly opposing manner, and exhibits the same actions and effects. In FIG. 4, the same components as those in FIG. 3 are denoted with the same reference numerals.

Figure 5:
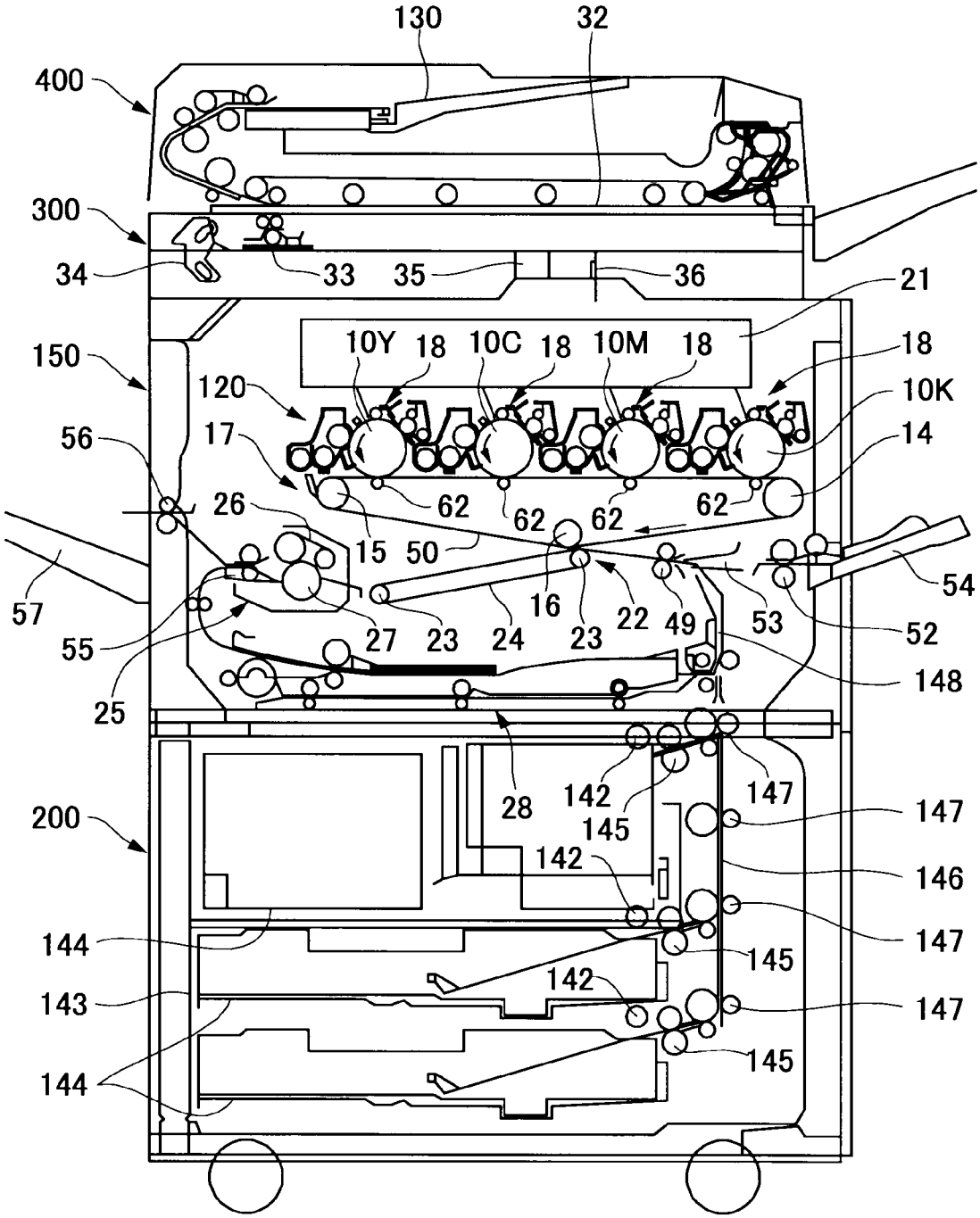
FIG. 5 is a schematic explanatory view showing an example to carry out an image forming method in the present invention by an image forming apparatus (tandem color image forming apparatus) used in the present invention.

Another aspect for carrying out the image forming method in the present invention by means of an image forming apparatus used in the present invention will be described with reference to FIG. 5. A tandem image forming apparatus as shown in FIG. 5 is a tandem color image forming apparatus. The tandem image forming apparatus includes a copier body 150, a paper feed table 200, a scanner 300, and an automatic document feeder (ADF) 400.

In the copier body 150, an endless belt-like intermediate transfer medium 50 is provided at the center portion. The intermediate transfer medium 50 is stretched around support rollers 14, 15, and 16 and is made rotatable clockwise in FIG. 5. In the vicinity of the support roller 15, arranged is a cleaning device 17 for removing a residual toner on the intermediate transfer medium 50. On the intermediate transfer medium 50 stretched by the support roller 14 and the support roller 15, arranged along its conveying direction is a tandem developing device 120 for which four yellow, cyan, magenta, and black image forming units 18 are juxtaposed in an opposing manner. In the vicinity of the tandem developing device 120, arranged is an exposing device 21. On the side opposite to the side where the tandem developing device 120 is arranged in the intermediate transfer medium 50, a secondary transferring device 22 is arranged. In the secondary transferring device 22, a secondary transfer belt 24 serving as an endless belt is stretched across a pair of rollers 23, and a transfer sheet and the intermediate transfer medium 50 conveyed on the secondary transfer belt 24 can contact each other. In the vicinity of the secondary transferring device 22, arranged is a fixing device 25. The fixing device 25 includes a fixing belt 26 serving as an endless belt and a pressure roller 27 arranged while being pressed there against.

Here, in the tandem image forming apparatus, arranged in the vicinity of the secondary transfer device 22 and the fixing device 25 is a sheet reversing device 28 for reversing a transfer sheet in order to form images on both surfaces of the transfer sheet.

Next, formation of a full-color image (color copy) using the tandem developing device 120 will be described. That is, first, a document is set on a document table 130 of the automatic document feeder (ADF) 400, or the automatic document feeder 400 is opened and a document is set on a contact glass 32 of the scanner 300, and then the automatic document feeder 400 is closed.

When the document has been set on the automatic document feeder 400, the scanner 300 is driven after the document is conveyed and moved onto the contact glass 32; on the other hand, when the document has been set on the contact glass 32, the scanner 300 is immediately driven, upon pressing a start switch (not shown), and a first traveler 33 and a second traveler 34 travel. At this time, by the first traveler 33, light from a light source is irradiated while a reflected light from the document surface is reflected by a mirror of the second traveler 34, the light is received by a reading sensor 36 through an imaging lens 35, and thus the color document (color image) is read as black, yellow, magenta, and cyan image information.

Figure 6:
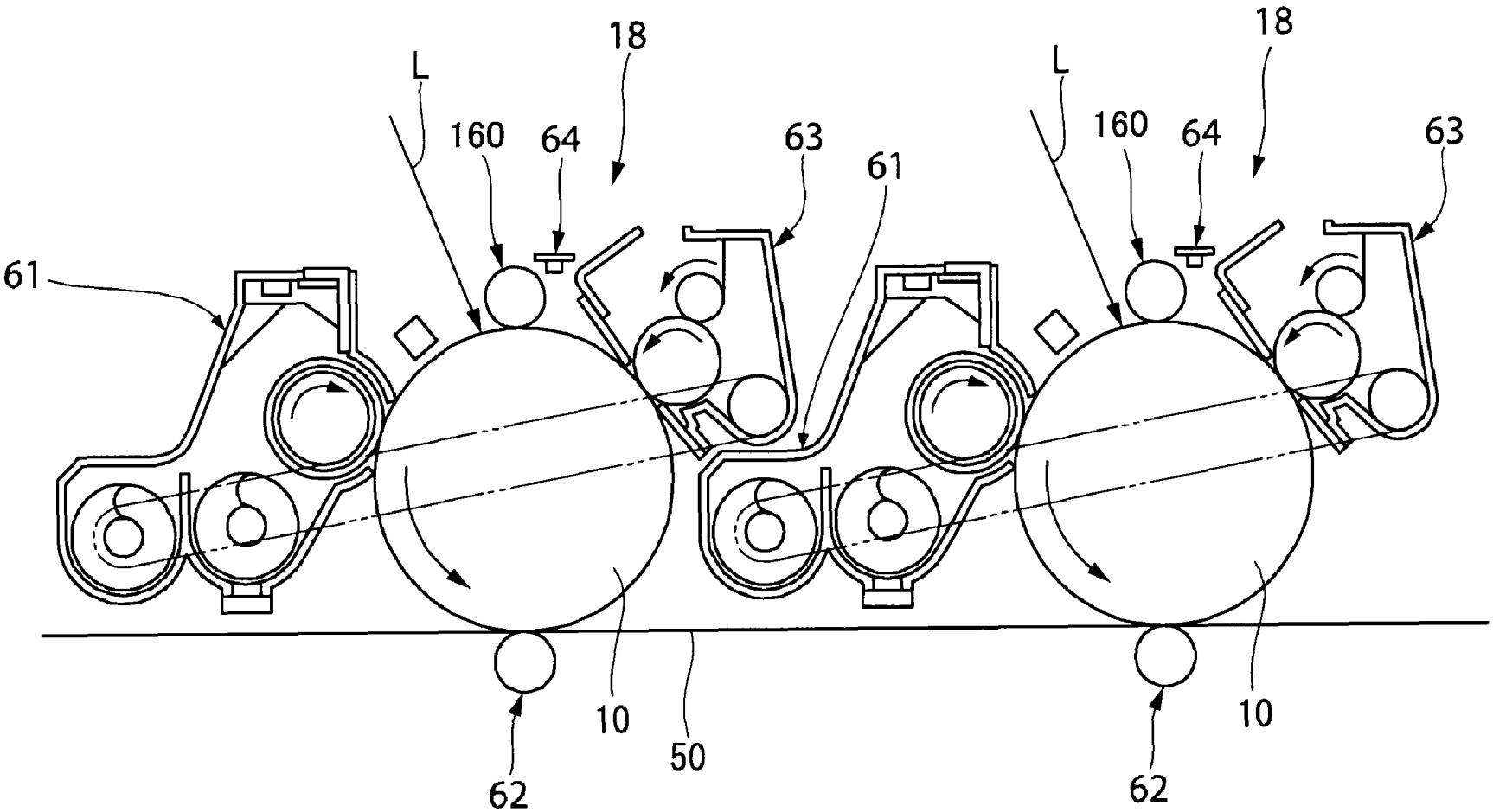
FIG. 6 is a partially enlarged schematic explanatory view of the image forming apparatus shown in FIG. 5.

Then, the respective black, yellow, magenta, and cyan image information are transmitted to the respective image forming units 18 (black image forming unit, yellow image forming unit, magenta image forming unit, and cyan image forming unit) of the tandem developing device 120, respectively, and black, yellow, magenta, and cyan toner images are formed by the respective image forming units. That is, the respective image forming units 18 (black image forming unit, yellow image forming unit, magenta image forming unit, and cyan image forming unit) of the tandem developing device 120 include, as shown in FIG. 6, photoconductors 10 (black photoconductor 10K, yellow photoconductor 10Y, magenta photoconductor 10M, and cyan photoconductor 10C), chargers 160 that uniformly charge the photoconductors, exposurers that expose ("L" in FIG. 6) the photoconductors imagewise corresponding to respective color images based on the respective color image information and thereby form latent electrostatic images corresponding to the respective color images on the photoconductors, developing devices 61 that develop the latent electrostatic images with respective color toners (black toner, yellow toner, magenta toner, and cyan toner) to form toner images of the respective color toners, transfer chargers 62 that transfer the toner images onto the intermediate transfer medium 50, photoconductor cleaning devices 63, and charge eliminating devices 64, respectively, and are capable of forming the respective single-color images (black image, yellow image, magenta image, and cyan image) based on the respective color image information. For the thus formed black image, yellow image, magenta image, and cyan image, a black image formed on the black photoconductor 10K, a yellow image formed on the yellow photoconductor 10Y, a magenta image formed on the magenta photoconductor 10M, and a cyan image formed on the cyan photoconductor 10C are respectively transferred (primary transfer) in sequence onto the intermediate transfer medium 50 rotationally moved by the support rollers 14, 15, and 16. Then, the black image, the yellow image, the magenta image, and the cyan image are superimposed on the intermediate transfer medium 50 to form a composite color image (color transfer image).

On the other hand, in the paper feed table 200, one of the paper feed rollers 142 is selectively rotated to let sheets (recording paper) out from one of the paper feed cassettes 144 provided in multiple tiers in a paper bank 143, and the sheets are separated by a separation roller 145 and separately sent out to a paper feed path 146, are conveyed by a conveyance roller 147 and guided to a paper feed path 148 within the copier body 150, and are made to hit against a resist roller 49 and stopped. Alternatively, the paper feed roller 142 is rotated to let sheets (recording paper) on a manual feed tray 54, and the sheets are separated by the separation roller 145 and separately fed into a manual paper feed path 53, and are similarly made to hit against the resist roller 49 and stopped. Here, the resist roller 49 is generally used grounded, but it may be used in a state where a bias is applied for removing paper powder of the sheets. Then, the resist roller 49 is rotated in timing with the composite color image (color transfer image) formed on the intermediate transfer medium 50 to send out the sheet (recording paper) between the intermediate transfer medium 50 and the secondary transferring unit 22, and the composite color image (color transfer image) is transferred (secondary transfer) onto the sheet (recording paper) by means of the secondary transferring unit 22 so as to form a color image on the sheet (recording paper). The residual toner on the intermediate transfer medium 50 after image is transferred is cleaned by the cleaning device 17 for the intermediate transfer medium.

The sheet (recording paper) on which a color image is transferred and formed is conveyed by the secondary transferring device 22 and sent out to the fixing device 25, and in the fixing device 25, the composite color image (color transfer image) is fixed onto the sheet (recording paper) by heat and pressure. Then, the sheet (recording paper) is switched by a switching claw 55, is discharged by a discharge roller 56, and is stacked on a discharged paper tray 57, or the sheet (recording paper) is switched by the switching claw 55, is reversed by the sheet reversing device 28, is guided again to the transfer position for recording an image on the rear surface as well, and then is discharged by the discharge roller 56 and is stacked on the discharged paper tray 57.

In the image forming apparatus and image forming method used in the present invention, since a developer containing the carrier of the present invention that is high in mechanical strength and is capable of forming an image having a high-image density without causing toner scattering and background smears is used, a high-quality image can be efficiently formed.

The present invention can solve the conventional problems and provide a carrier which has a coating layer having a uniform thickness on a surface of a core material, high adhesion property between the core material and the coating layer and high mechanical strength, a method for producing the carrier, a developer using the carrier, which developer can provide a fine image having a high-image density for a long time without causing toner scattering, background smear and edge effect, and an image forming method using the developer.

EXAMPLES

Hereinafter, Examples of the present invention will be described, which however shall not be construed as limiting the scope of the present invention. All percentages and parts are by mass unless indicated otherwise.

Preparation Example 1

-Preparation of Toner 1-

One hundred (100) parts of a polyester resin (weight-average molecular weight=12,000), 2 parts of a copper phthalocyanine pigment, and 2 parts of a charge control agent represented by the following structural formula A (iodine salt of nonylene perfluoroether p-trimethylaminopropyl amidophenyl) were kneaded at 120° C. by a heat roll, cooled to solidify, and then pulverized and classified to obtain toner base particles having a volume-average particle diameter of 7.1 μm, a number-average particle diameter of 5.8 μm, and an average circularity of 0.953.

Structural Formula A

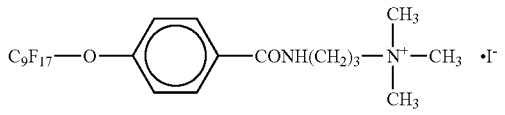

Next, to 100 parts of the obtained toner base particles, 0.5 parts of silica R972 (manufactured by NIPPON AEROSIL CO., LTD.) was added and mixed to prepare "Toner 1."

Preparation Example 2

-Preparation of Toner 2-

One hundred (100) parts of a polyester resin (weight-average molecular weight=12,000), 5 parts of carbon black, and 2 parts of a chromium-containing azo dye represented by the following structural formula B were kneaded at 120° C. by a heat roll, cooled to solidify, and then pulverized and classified to obtain toner base particles having a volume-average particle diameter of 7.3 μm, a number-average particle diameter of 6.0 μm, and an average circularity of 0.955.

Structural Formula B

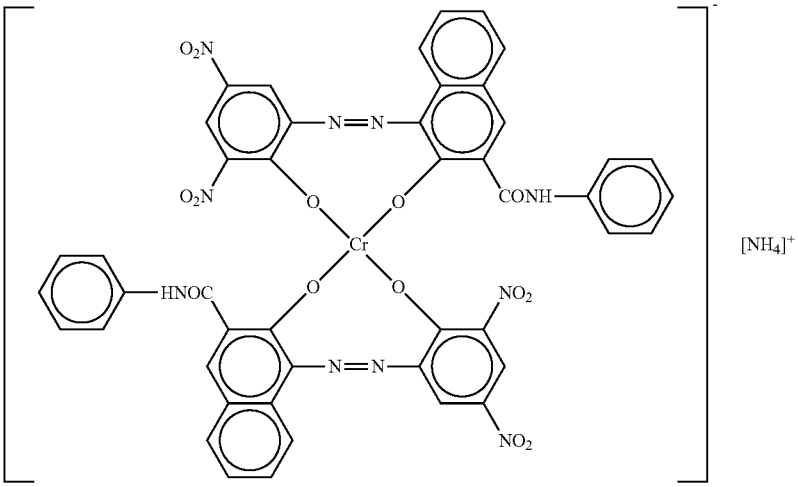

Next, to 100 parts of the obtained toner base particles, 0.5 parts of silica R972 (manufactured by NIPPON AEROSIL CO., LTD.) was added and mixed to prepare "Toner 2."

Preparation Example 3

<Preparation of Toner 3>

-Synthesis of Organic Fine Particle Emulsion-

In a reaction vessel equipped with a stirring rod and a thermometer, 683 parts of water, 11 parts of a sodium salt of sulfate ester of ethylene oxide adduct of methacrylic acid (ELEMINOL RS-30 manufactured by Sanyo Chemical Industries, Ltd.), 83 parts of styrene, 83 parts of methacrylic acid, 110 parts of butyl acrylate, and 1 part of ammonium persulfate were charged, and stirred at 400 rpm for 15 minutes to obtain a white emulsion. This emulsion was heated to a temperature of 75° C. and reacted for 5 hours. Next, 30 parts of a 1% by mass aqueous solution of ammonium persulfate was added thereto and aged at 75° C. for 5 hours to obtain an aqueous dispersion of a vinyl resin (copolymer of methacrylic acid-butyl acrylate-sodium salt of sulfuric acid ester of ethylene oxide adduct of methacrylic acid). This aqueous dispersion is referred to as "Fine Particle Dispersion 1."

The fine particles contained in the obtained "Fine Particle Dispersion 1" had a volume-average particle diameter of 105 nm measured on a laser scattering particle diameter distribution analyzer ("LA-920" manufactured by HORIBA, Ltd.). In addition, a part of [Fine Particle Dispersion 1]" was dried to isolate only a resin component. This resin component had a glass transition temperature (Tg) of 59° C. and a weight-average molecular weight (Mw) of 150,000.

-Preparation of Aqueous Phase-

Nine hundred ninety (990) parts of water, 83 parts of [Fine Particle Dispersion 1], 37 parts of a 48.5% aqueous solution of sodium dodecyl diphenyl ether disulfonate (ELEMINOL MON-7 manufactured by Sanyo Chemical Industries, Ltd.), and 90 parts of ethyl acetate were mixed and stirred to obtain a milky white liquid [Aqueous Phase 1].

-Synthesis of Low-Molecular Polyester-

In a reaction vessel equipped with a cooling tube, a stirrer, and a nitrogen introducing tube, 229 parts of an ethylene oxide 2-mol adduct of bisphenol A, 529 parts of a propylene oxide 3-mol adduct of bisphenol A, 208 parts of terephthalic acid, 46 parts of adipic acid, and 2 parts of dibutyltin oxide were charged and reacted at 230° C. under normal pressure for 8 hours and was further reacted under a reduced pressure of 10 mmHg to 15 mmHg for 5 hours, then 44 parts of trimellitic anhydride was charged in the reaction vessel, and the mixture was reacted at 180° C. under normal pressure for 2 hours to synthesize [Low-Molecular Polyester 1].

The obtained [Low-Molecular Polyester 1] had a glass-transition temperature (Tg) of 45° C., a weight-average molecular weight of 5,800, a number-average molecular weight of 2,600, and an acid value of 24 mgKOH/g.

-Synthesis of Polyester Prepolymer-

In a reaction vessel equipped with a cooling tube, a stirrer, and a nitrogen introducing tube, 682 parts of ethylene oxide 2-mol adduct of bisphenol A, 81 parts of a propylene oxide 2-mol adduct of bisphenol A, 283 parts of terephthalic acid, 22 parts of trimellitic anhydride, and 2 parts of dibutyltin oxide were charged and reacted at 230° C. under normal pressure for 8 hours. Then, the mixture was further reacted under a reduced pressure of 10 mmHg to 15 mmHg for 5 hours to synthesize [Intermediate Polyester 1].

The obtained [Intermediate Polyester 1] had a number-average molecular weight of 2,100, a weight-average molecular weight of 9,500, a glass transition temperature (Tg) of 55° C., an acid value of 0.5 mgKOH/g, and a hydroxyl value of 51 mgKOH/g.

Next, in a reaction vessel equipped with a cooling tube, a stirrer, and a nitrogen introducing tube, 410 parts of [Intermediate Polyester 1], 89 parts of isophorone diisocyanate, and 500 parts of ethyl acetate were charged and reacted at 100° C. for 5 hours to obtaine [Prepolymer 1].

The obtained [Prepolymer 1] had a free isocyanate content of 1.74%.

-Synthesis of Ketimine-

In a reaction vessel equipped with a stirring rod and a thermometer, 170 parts of isophoronediamine and 75 parts of methyl ethyl ketone were charged and reacted at 50° C. for 5 hours to synthesize [Ketimine Compound 1]. The obtained [Ketimine Compound 1] had an amine value of 418.

-Preparation of Master Batch (MB)-

One thousand two hundred (1,200) parts of water, 540 parts of carbon black (PBk-7: Printex 60, manufactured by Degussa AG, DBP oil absorbance: 114 ml/100 mg, pH: 10), and 1,200 parts of a polyester resin (RS801 manufactured by Sanyo Chemical Industries, Ltd.) were mixed by a HEN- SCHEL MIXER (manufactured by MITSUI MINING Co., Ltd.). The obtained mixture was kneaded at 150° C. for 30 minutes by a two-roll mill, then rolled and cooled, and pulverized by a pulverizer to obtain a master batch [Master Batch 1].

-Preparation of Oil Phase-

In a reaction vessel equipped with a stirring rod and a thermometer, 300 parts of [Low-Molecular Polyester 1], 90 parts of carnauba wax, 10 parts of rice wax, and 1,000 parts of ethyl acetate were charged and dissolved at 79° C. under stirring, and then rapidly cooled to 4° C. The mixture was dispersed by a bead mill (ULTRAVISCOMILL manufactured by Aimex Co., Ltd.) which was filled with 80% by volume of 0.5 mm-zirconia beads under the conditions of a liquid feeding speed of 1 kg/hr, a disk circumferential speed of 6 m/sec., and 3 times-pass through, to obtain a wax dispersion having a volume-average particle diameter of 0.6 μm.

Next, 500 parts of [Master Batch 1] and 640 parts of a 70% of ethyl acetate solution of [Low-Molecular Polyester 1] were added and mixed for 10 hours, and then passed through the bead mill 5 times, and ethyl acetate was added to adjust and prepare [Oil Phase 1] having a solid content concentration of 50%.

-Preparation of Polymerized Toner-

In a vessel 73.2 parts of [Oil Phase 1], 6.8 parts of [Prepolymer 1], and 0.48 parts of [Ketimine Compound 1] were charged and sufficiently mixed. In the thus obtained [Emulsified Oil Phase 1], 120 parts of [Aqueous Phase 1] was added and mixed by a homomixer for 1 minute, then the mixture was sheared while being slowly stirred with a paddle for 1 hour to obtain [Emulsified Slurry 1].

The obtained [Emulsified Slurry 1] was de-solvented at 30° C. for 1 hour, further aged at 60° C. for 5 hours, and washed in water, filtrated, and dried, and then sieved with a mesh screen having an opening size of 75 μm to prepare toner base particles having a volume-average particle diameter of 6.1 μm, a number-average particle diameter of 5.4 μm, and an average circularity of 0.972.

Next, 0.7 parts of hydrophobic silica and 0.3 parts of hydrophobized titanium oxide were mixed into 100 parts of the obtained toner base particles by a HENSCHEL MIXER to prepare "Toner 3".

Example 1

-Preparation of Carrier 1-

Using a device as shown in FIG. 1, in a carrier treatment tank 110 (inner volume: 400 mL), 7 parts of a silicone resin A (weight average molecular weight (Mw)=12,500, number average molecular weight (Mn)=6,500, Mw/Mn=1.92) and 100 parts of a ferrite core material having a volume average particle diameter of 35 μm (saturated magnetic moment at 1 k gauss=65 emu/g) were charged. A valve 3 was opened while stirring the components in the carrier treatment tank 110, carbon dioxide (purity=99.5%, manufactured by GASTEC SERVICE INC.) was supplied therein using a pressurizing pump P1 to be a condition of 25 MPa and 40° C., and then the valve 3 was closed.

Next, the inside of the carrier treatment tank 110 were kept at 25 MPa and 40° C. for 2 hours, then the valves 5 and 6 were opened to restore the inside to the normal pressure range by means of a depressurizing pump D1 in 2 hours. Further, the inside of the carrier treatment tank 110 was heated at 160° C. for 2 hours (coating layer formation step). A coating material that had not been used could be collected from the raw material recycling tank and recycled.

In a carrier treatment tank, 10 parts of pyrrole as a polymer precursor was added, a valve 3 was opened while stirring the components in the carrier treatment tank 110, carbon dioxide (purity=99.5%, manufactured by GASTEC SERVICE INC.) was supplied therein using a pressurizing pump P1 to be a condition of 25 MPa and 40° C., and then the valve 3 was closed.

The inside of the carrier treatment tank 110 was kept in a treatment condition 1 (at 20 MPa, 40° C.) for 1 hour, then the valves 5 and 6 were opened to restore the inside to the normal pressure range by means of a depressurizing pump D1 in 2 hours (coating layer treatment step). Pyrrole that had not been used could be collected from the raw material recycling tank and recycled.

Next, the carrier taken out from the carrier treatment tank 110 was immersed in 2.25 mol/L of an aqueous solution of ferric chloride for 20 minutes (oxidation treatment step).

The obtained carrier was sufficiently washed with distilled water, and then dried. Thus, Carrier 1 was prepared.

The obtained Carrier 1 had a coating layer having a thickness of 0.55 μm and an electric resistance LogR of 13.5 Ω·cm.

<Measurement of Thickness of Coating Layer>

The thickness of coating layer was measured by observing a cross-section of a carrier on a transmission electron microscope (TEM).

<Measurement of Electric Resistance of Carrier>

A vessel equipped with electrodes placed in parallel at 2 mm intervals was filled with a carrier, and a direct current resistance with a potential difference of 50V between the electrodes was measured on 4329A HIGH RESISTANCE METER manufactured by Hewlett-Packard Development Co., L.P.

Example 2

-Preparation of Carrier 2-

Carrier 2 was prepared in the same manner as in Example 1 except that a silicone resin B (weight average molecular weight (Mw)=18,000, number average molecular weight (Mn)=9,000, Mw/Mn=2.00, transition temperature from solid=60° C.) was used instead of the silicone resin A in Example 1.

The coating layer in the obtained Carrier 2 was measured in the same manner as in Example 1. The coating layer formed in Carrier 2 had a thickness of 0.52 μm and an electric resistance LogR of 13.5 Ω·cm.

Example 3

-Preparation of Carrier 3-

Carrier 3 was prepared in the same manner as in Example 1 except that pyrrole as the polymer precursor in Example 1 was changed to aniline.

The coating layer in the obtained Carrier 3 was measured in the same manner as in Example 1. The coating layer formed in Carrier 3 had a thickness of 0.54 μm and an electric resistance LogR of 13.7 Ω·cm.

Example 4

-Preparation of Carrier 4-

Carrier 4 was prepared in the same manner as in Example 2 except that pyrrole as the polymer precursor in Example 2 was changed to aniline.

The coating layer in the obtained Carrier 4 was measured in the same manner as in Example 1. The coating layer formed in Carrier 4 had a thickness of 0.52 μm and an electric resistance LogR of 13.8 Ω·cm.

Example 5

-Preparation of Carrier 5-

Carrier 5 was prepared in the same manner as in Example 1 except that the treatment condition 1 in Example 1 was changed to a treatment condition 2 (30 MPa, 40° C.).

The coating layer in the obtained Carrier 5 was measured in the same manner as in Example 1. The coating layer formed in Carrier 5 had a thickness of 0.50 μm and an electric resistance LogR of 13.1 Ω·cm.

Example 6

-Preparation of Carrier 6-

Carrier 6 was prepared in the same manner as in Example 1 except that pyrrole as the polymer precursor in Example 1 was changed to N-methyl pyrrole.

The coating layer in the obtained Carrier 6 was measured in the same manner as in Example 1. The coating layer formed in Carrier 6 had a thickness of 0.54 μm and an electric resistance LogR of 13.6 Ω·cm.

Example 7

-Preparation of Carrier 7-

Carrier 7 was prepared in the same manner as in Example 1 except that in the oxidation treatment step, the aqueous solution of ferric chloride was changed to a 1.0 mol/L ammonium persulfate solution in which ammonium persulfate was added to a 1.0N hydrochloric acid aqueous solution.

The coating layer in the obtained Carrier 7 was measured in the same manner as in Example 1. The coating layer formed in Carrier 7 had a thickness of 0.54 μm and an electric resistance LogR of 13.5 Ω·cm.

Example 8

-Preparation of Carrier 8-

A dispersion composed of 1,000 parts of a toluene solution (solid content concentration=10%) of a silicone resin A (weight average molecular weight (Mw)=12,500, number average molecular weight (Mn)=6,500, Mw/Mn=1.92, transition temperature from solid=45° C.) and 5 parts of a catalyst $[(CH_3)_2Sn(OCOCH_3)_2]$ was stirred and applied over the surface of 5,000 parts of a ferrite core material having a volume average particle diameter of 35 μm (saturated magnetic moment at 1 k gauss=65 emu/g) at a coating rate of 50 g/min for 20 minutes under an atmosphere of 100° C. using a fluidized-bed coating device. The obtained ferrite particle coated with the silicone resin was heated at 200° C. for 1 hour (coating layer formation step).

In a carrier treatment tank 110 (inner volume: 400 mL) in a carrier production device shown in FIG. 1, the obtained ferrite particle coated with the silicone resin was loaded, 10 parts of pyrrole as a polymer precursor was added therein, and a valve 3 was opened while stirring the components in the carrier treatment tank 110 to be supplied with carbon dioxide (purity=99.5%, manufactured by GASTEC SERVICE INC.) using a pressurizing pump P1 so as to be a condition of 25 MPa and 40° C., and then the valve 3 was closed.

Next, the inside of the carrier treatment tank 110 was kept in a treatment condition 1 (at 20 MPa, 40° C.) for 1 hour, then the valves 5 and 6 were opened to restore the inside to a normal pressure range by means of a depressurizing pump D1 in 2 hours (coating layer treatment step). Pyrrole that had not been used could be collected from the raw material recycling tank and recycled.

Next, the carrier taken out from the carrier treatment tank 110 was immersed in 2.25 mol/L of an aqueous solution of ferric chloride for 20 minutes (oxidation treatment step).

The obtained carrier was sufficiently washed with distilled water, and then dried. Thus, Carrier 8 was prepared.

The coating layer in the obtained Carrier 8 was measured in the same manner as in Example 1. The coating layer formed in Carrier 8 had a thickness of 0.60 μm and an electric resistance LogR of 13.9 Ω·cm.

Example 9

-Preparation of Carrier 9-

Carrier 9 was prepared in the same manner as in Example 8 except that pyrrole as the polymer precursor in Example 8 was changed to aniline.

The coating layer in the obtained Carrier 9 was measured in the same manner as in Example 1. The coating layer formed in Carrier 9 had a thickness of 0.59 μm and an electric resistance LogR of 13.9 Ω·cm.

Comparative Example 1

-Preparation of Comparison Carrier 1-

A dispersion composed of 1,000 parts of a toluene solution (solid content concentration=10%) of a silicone resin A (weight average molecular weight (Mw)=12,500, number average molecular weight (Mn)=6,500, Mw/Mn=1.92, transition temperature from solid=45° C.), 5 parts of a catalyst $[(CH_3)_2Sn(OCOCH_3)_2]$ and 50 parts of Alumina (SUMICORUNDUM AA-04 by Sumitomo Chemical Co., Ltd., 0.4 μm, axial ratio: 1.1) was stirred, and then was applied over the surface of 5,000 parts of a ferrite core material having a volume average particle diameter of 35 μm (saturated magnetic moment at 1 k gauss=65 emu/g) at a coating rate of 50 g/min for 20 minutes under an atmosphere of 100° C. using a fluidized-bed coating device.

The obtained ferrite particle coated with the silicone resin was heated at 200° C. for 1 hour to prepare Comparison Carrier 1.

The coating layer in the obtained Comparison Carrier 1 was measured in the same manner as in Example 1. The coating layer formed in Comparison Carrier 1 had a thickness of 0.62 μm and an electric resistance LogR of 14.2 Ω·cm.

Comparative Example 2

-Preparation of Comparison Carrier 2-

A dispersion composed of 1,000 parts of a toluene solution (solid content concentration=10%) of a silicone resin A(weight average molecular weight (Mw)=12,500, number average molecular weight (Mn)=6,500, Mw/Mn=1.92, transition temperature from solid=45° C.) and 5 parts of a catalyst $[(CH_3)_2Sn(OCOCH_3)_2]$ was stirred, and then was applied over the surface of 5,000 parts of a ferrite core material having a volume average particle diameter of 35 μm (saturated magnetic moment at 1 k gauss=65 emu/g at a coating rate of 50 g/min for 20 minutes under an atmosphere of 100° C. using a fluidized-bed coating device.

The obtained ferrite particle coated with the silicone resin was heated at 200° C. for 1 hour (coating layer formation step).

In a carrier treatment tank 110 (inner volume: 400 mL) in the device shown in FIG. 1, the obtained ferrite particle coated with the silicone resin was loaded, and 10 parts of pyrrole as a polymer precursor was added therein, and a valve 3 was opened while stirring the components in the carrier treatment tank 110 to be supplied with carbon dioxide (purity=99.5%, manufactured by GASTEC SERVICE INC.) using a pressurizing pump P1 so as to be a condition of 25 MPa, 40° C., and then the valve 3 was closed.

Next, the inside of the carrier treatment tank 110 was kept in a treatment condition 1 (at 20 MPa, 40° C.) for 1 hour, then the valves 5 and 6 were opened to restore the inside to the normal pressure range by means of a depressurizing pump D1 in 2 hours (coating layer treatment step). Pyrrole that had not been used could be collected from the raw material recycling tank and recycled. Thus, Comparison Carrier 2 was prepared.

The coating layer in the obtained Comparison Carrier 2 was measured in the same manner as in Example 1. The coating layer formed in Comparison Carrier 1 had a thickness of 0.62 μm and an electric resistance LogR of 17.0 Ω·cm.

Examples 10 to 20 and Comparative Examples 3 and 4

-Preparation of Developer-

The prepared Carriers 1 to 9, Comparison Carriers 1 and 2, and Toners 1 to 3 were respectively combined as shown in Table 1 to prepare respective developers of Examples 10 to 20 and Comparative Examples 3 and 4 by a conventional method.

Next, the image density, toner scattering, background smear and edge effect of the obtained respective developers were evaluated. The evaluation results are shown in Table 1.

<Image Density>

In a tandem color image forming apparatus (Imagio NEO 450, manufactured by Ricoh Company, Ltd.), using the obtained respective developers, solid images of 1.00±0.05 mg/cm$^2$ in adhesion amount of the respective developers were formed on copying papers (TYPE 6000<70 W> manufactured by Ricoh Company, Ltd.). The solid images were repeatedly formed on 1,000,000 sheets of the copying papers.

The image density of the obtained solid images were visually observed at the initial stage and after endurance test of outputting 1,000,000 sheets of copying paper, and the respective developers were evaluated based on the following criteria. The higher image density, the better the quality of image. This evaluation is equivalent to an example of the developer and the image forming method in the present invention.

[Evaluation Criteria]

A: At the initial stage of the endurance test of outputting 1,000,000 sheets and after the endurance test, it was possible to obtain a high-quality image with no change in image density.

B: After the endurance test of outputting 1,000,000 sheets, it was possible to obtain a high-quality image, although the image density was slightly reduced.

C: After the endurance test of outputting 1,000,000 sheets, the image density lowered, and the quality of the image decreased.

D: After the endurance test of outputting 1,000,000 sheets, the image density remarkably lowered, and the quality of the image significantly decreased.

<Toner Scattering>

After continuously outputting 1,000,000 sheets of a 5% image-area ratio chart in a tandem color image forming apparatus (Imagio NEO 450, manufactured by Ricoh Company, Ltd.), the level of toner contamination in the image forming apparatus was visually observed and evaluated by four ranks based on the following criteria.

[Evaluation Criteria]

A: No toner contamination was observed at all in the image forming apparatus, and an excellent state was maintained.

B: No toner contamination was observed in the image forming apparatus, and a satisfactory state was maintained.

C: Toner contamination was observed in the image forming apparatus, however, it was still on the practical level.

D: Toner contamination was severe in the image forming apparatus, and it was far from the practical level.

<Background Smear>

After continuously outputting 1,000,000 sheets of a 5% image-area ratio chart in a tandem color image forming apparatus (Imagio NEO 450, manufactured by Ricoh Company Ltd.), the level of background smear in the image forming apparatus was visually observed and evaluated based on the following criteria.

[Evaluation Criteria]

A: No smear was observed on the image background.

B: Smear was slightly observed on the image background.

C: Smear was clearly observed on the image background.

<Edge Effect>

Respective developers were set in a commercially available digital full-color printer (IPSiO CX8200 by Ricoh Company, Ltd.) which had been modified, and test patterns having large image areas were output. On the obtained image pattern, the difference between the image density of the central portion and the image density of the edge portion was evaluated by four ranks based on the following criteria.

[Evaluation Criteria]

A: No density difference

B: Slight density difference

C: Acceptable density difference

D: Unacceptable density difference

<Total Evaluation>

From the above-mentioned evaluation results, the respective developers were evaluated based on the following criteria.

[Evaluation Criteria]

A: Excellent

B: Good

C: Poor

TABLE 1

| | Carrier | Toner | Image density | Toner scattering | Background smear | Edge effect | Total evaluation |
|---|---|---|---|---|---|---|---|
| Ex. 10 | Carrier 1 | Toner 3 | A | A | A | B | A |
| Ex. 11 | Carrier 1 | Toner 2 | A | A | A | B | A |
| Ex. 12 | Carrier 1 | Toner 1 | A | A | A | B | A |
| Ex. 13 | Carrier 2 | Toner 3 | A | B | A | B | B |
| Ex. 14 | Carrier 3 | Toner 3 | A | B | A | B | B |
| Ex. 15 | Carrier 4 | Toner 3 | A | B | A | B | B |
| Ex. 16 | Carrier 5 | Toner 3 | A | A | A | A | A |
| Ex. 17 | Carrier 6 | Toner 3 | A | A | A | B | A |
| Ex. 18 | Carrier 7 | Toner 3 | A | A | A | B | A |
| Ex. 19 | Carrier 8 | Toner 3 | A | B | A | B | B |
| Ex. 20 | Carrier 9 | Toner 3 | A | B | A | B | B |
| Comp. Ex. 3 | Comparison Carrier 1 | Toner 3 | D | D | C | D | C |
| Comp. Ex. 4 | Comparison Carrier 2 | Toner 3 | D | D | C | D | C |

As can be seen from the result of Table 1, the developers of Examples 10 to 20 respectively using Carriers 1 to 9, in which the coating layers on the surfaces of the core materials were treated with the polymer precursors in the supercritical fluid and then subjected to oxidization treatment, could be used to provide fine images having high-image density for a long time without causing toner scattering, background smear and edge effect, compared with the developers of Comparative Examples 3 and 4 respectively using Comparison Carriers 1 and 2.

A carrier produced by the method for producing a carrier of the present invention has a coating layer having a uniform thickness on the surface of a core material, a high adhesion property between the core material and the coating layer, and high mechanical strength, thereby preferably used for the developer of the present invention.

The developer of the present invention contains the carrier of the present invention and a toner. By using the developer, a high density image can be formed without substantially causing toner scattering and background smear.

The image forming method used in the present invention allows for obtaining a fine, high-quality image having high-mechanical strength, high density without substantially causing toner scattering, background smear and edge effect. Therefore, the image forming method in the present invention can be preferably used for various electrophotographic image forming apparatuses.

What is claimed is:

1. A method for producing a carrier comprising:

treating a coating layer on a surface of a core material with a polymer precursor in a supercritical fluid and/or a subcritical fluid so as to add the polymer precursor to the coating layer; and subjecting the coating layer to oxidation treatment so as to form a polymer from the polymer precursor in the coating layer.

2. The method for producing a carrier according to claim 1, wherein the polymer formed from the polymer precursor has electrical conductivity.

3. The method for producing a carrier according to claim 1, wherein the polymer precursor is at least one selected from compounds partly having at least one of a five-membered aromatic structure and an aniline structure.

4. The method for producing a carrier according to claim 3, wherein the compound partly having at least one of a five-membered aromatic structure and an aniline structure is at least one selected from pyrrole, pyrrole derivative and aniline.

5. The method for producing a carrier according to claim 1, wherein the oxidation treatment is performed using an oxidant.

6. The method for producing a carrier according to claim 5, wherein the oxidant comprises at least one selected from a transition metal chloride, a halogen atom and a peroxyacid compound.

7. The method for producing a carrier according to claim 1, further comprising dissolving and/or dispersing at least a coating resin in the supercritical fluid and/or the subcritical fluid so as to form the coating layer on the surface of the core material.

8. The method for producing a carrier according to claim 1, wherein the supercritical fluid and/or the subcritical fluid is carbon dioxide.

9. A carrier produced by a method for producing the carrier comprising:

treating a coating layer on a surface of a core material with a polymer precursor in a supercritical fluid and/or a subcritical fluid so as to add the polymer precursor to the coating layer; and subjecting the coating layer to oxidation treatment so as to form a polymer from the polymer precursor in the coating layer.

10. A developer comprising:

a carrier; and a toner, wherein the carrier is produced by a method for producing the carrier comprising:

treating a coating layer on a surface of a core material with a polymer precursor in a supercritical fluid and/or a subcritical fluid so as to add the polymer precursor to the coating layer; and subjecting the coating layer to oxidation treatment so as to form a polymer from the polymer precursor in the coating layer.

* * * * *